US012408780B2

(12) United States Patent
Huang

(10) Patent No.: US 12,408,780 B2
(45) Date of Patent: Sep. 9, 2025

(54) DISPOSABLE PAPER PULP FAST FOOD CUTLERY

(71) Applicant: Yun Huang, North Brunswick, NJ (US)

(72) Inventor: Yun Huang, North Brunswick, NJ (US)

( * ) Notice: Subject to any disclaimer, the term of this patent is extended or adjusted under 35 U.S.C. 154(b) by 303 days.

(21) Appl. No.: 17/689,337

(22) Filed: Mar. 8, 2022

(65) Prior Publication Data

US 2022/0338651 A1 Oct. 27, 2022

(30) Foreign Application Priority Data

Apr. 27, 2021 (CN) ..... 202120881266.7
Apr. 27, 2021 (CN) ..... 202120884091.5
Apr. 27, 2021 (CN) ..... 202120884253.5

(51) Int. Cl.
*A47G 21/04* (2006.01)
*A47G 21/02* (2006.01)

(52) U.S. Cl.
CPC ..... *A47G 21/04* (2013.01); *A47G 21/02* (2013.01); *A47G 21/023* (2013.01)

(58) Field of Classification Search
CPC ..... A47G 21/02–06; A47J 43/28–282; A61J 7/0023
USPC ..... D7/642–645, 653; 30/142, 147–150, 30/322–328
See application file for complete search history.

(56) References Cited

U.S. PATENT DOCUMENTS 1,435,890 A * 11/1922 Bothe ..... A47G 21/04 30/328
1,868,426 A * 7/1932 Momberger ..... A47G 21/04 30/328
1,907,737 A * 5/1933 Christie ..... A47G 21/04 30/328
2,216,005 A * 9/1940 Goldstein ..... A47G 21/02 30/150

(Continued)

FOREIGN PATENT DOCUMENTS

CN 211582526 U 9/2020
CN 215226626 U * 12/2021 ..... A47G 21/02

(Continued)

OTHER PUBLICATIONS

14 Stars Bamboo Wooden Disposable Spoons, Nov. 20, 2020, https://www.amazon.com/Disposable-14-Biodegradable-Wood-Sturdy-Christmas/dp/B08P2143K4 (Year: 2020), 8 pages.

(Continued)

*Primary Examiner* — Jason Daniel Prone
(74) *Attorney, Agent, or Firm* — ZIEGLER IP LAW GROUP, LLC.

(57) ABSTRACT

A piece of pulp cutlery includes a handle, a working body, and a transition portion by which the handle is connected with the working body. The handle includes two curved lateral edge portions, and a first double arch reinforcing structure disposed between the two curved lateral edge portions and extending along a length of the handle. The transition portion includes a second double arch reinforcing structure which extends from the first double arch reinforc- (Continued)

ing structure and toward the working body. The working body includes a third double arch reinforcing structure which extends from the second double arch reinforcing structure and toward a lowest region of the working body.

13 Claims, 16 Drawing Sheets

(56) References Cited

U.S. PATENT DOCUMENTS 2,440,136 A * 4/1948 Barnes ..... A47G 21/02 30/165
D152,438 S * 1/1949 Skrastin, Jr. ..... D7/653
D171,579 S * 3/1954 Cayer ..... D7/653
2,752,678 A * 7/1956 Welch ..... A47G 21/04 D7/653
D236,420 S * 8/1975 Dart et al. ..... D7/653
4,524,512 A * 6/1985 Formo ..... A47G 21/06 30/147
4,589,204 A * 5/1986 Vogel ..... A47G 21/02 30/324
4,615,120 A * 10/1986 Newman ..... A47G 21/02 30/324
D299,899 S * 2/1989 Liebmann ..... D7/653
4,826,033 A * 5/1989 Satoh ..... A47G 21/02 30/322
4,841,637 A * 6/1989 Scholzen ..... A47G 21/004 30/324
5,327,650 A * 7/1994 Rojas ..... A47G 21/06 30/147
5,419,049 A * 5/1995 Macarthur-Onslow ..... A47G 21/02 30/322
D362,160 S * 9/1995 Brabeck ..... D7/643
D364,075 S * 11/1995 Brogren ..... D7/653
5,735,050 A * 4/1998 Hsieh ..... A47G 21/04 30/322
5,845,403 A * 12/1998 Nivin ..... A47G 21/06 30/147
5,904,250 A * 5/1999 De Schutter ..... A47G 21/06 30/142
D411,938 S * 7/1999 Morrison ..... D7/401.2
D431,424 S * 10/2000 Junko ..... D7/653
D483,478 S * 12/2003 Carraher ..... D7/653
7,013,568 B2 * 3/2006 Schmidt ..... A47G 21/06 30/147
D530,987 S * 10/2006 Lee ..... D7/653
D531,860 S * 11/2006 Lee ..... D7/653
D533,034 S * 12/2006 Wasserman ..... D7/653
D536,222 S * 2/2007 Heiberg ..... D7/645
D546,136 S * 7/2007 Smith ..... D7/653
D560,442 S * 1/2008 Teys ..... D7/653
D594,711 S 6/2009 Coppo
D614,921 S * 5/2010 Bardolet ..... D7/645
7,716,842 B2 * 5/2010 Sumner-Trivisani ..... A47G 21/02 30/322
7,856,722 B2 * 12/2010 Lago-Arenas ..... A47G 21/06 D7/645
D635,672 S * 4/2011 Ripich ..... D24/147
D637,038 S * 5/2011 Lenge ..... D7/653
8,296,957 B2 * 10/2012 Muehlemann ..... A47G 21/02 30/147
D686,045 S * 7/2013 Stewart ..... D7/642
D705,604 S * 5/2014 Ng ..... D7/642
D732,352 S * 6/2015 Ebli ..... D7/653
D756,172 S * 5/2016 Mou ..... D7/653
D758,796 S * 6/2016 Miller ..... D7/653
D774,847 S 12/2016 Isopahkala
D775,498 S * 1/2017 Gallop ..... D7/642
D778,123 S 2/2017 Mou
D778,124 S 2/2017 Mou
D778,689 S * 2/2017 Grewal ..... D7/642
D782,884 S 4/2017 Aschner
D795,657 S 8/2017 Aschner
D795,658 S 8/2017 Aschner
D796,916 S 9/2017 McFarland et al.
D828,118 S * 9/2018 Mackall, Jr. ..... D7/645
D828,730 S * 9/2018 Gauss ..... D7/643
10,081,095 B1 * 9/2018 Lee ..... A47G 21/02
D840,769 S * 2/2019 Malcolm ..... A47G 21/02 D7/653
D841,408 S 2/2019 Isopahkala
D851,466 S * 6/2019 Oakes ..... D7/645
D858,215 S * 9/2019 Liming ..... D7/653
D862,995 S 10/2019 Androxman
D909,147 S 2/2021 Lacotta et al.
D909,822 S 2/2021 Lacotta et al.
D909,824 S 2/2021 Tillman
10,959,555 B2 * 3/2021 Lee ..... A47G 21/04
11,033,134 B2 * 6/2021 Mithal ..... A47G 21/02
11,034,011 B2 * 6/2021 Bessac ..... A47G 21/06
11,083,315 B2 * 8/2021 Park ..... A47G 21/04
D948,971 S * 4/2022 Mack ..... D7/642
D959,927 S * 8/2022 Hong ..... D7/653
D986,010 S * 5/2023 Huang ..... D7/649
D986,012 S * 5/2023 Huang ..... D7/653
D990,989 S * 7/2023 Huang ..... D7/653
D1,019,291 S * 3/2024 Jonsson ..... D7/653
D1,028,639 S * 5/2024 Gallop ..... A47G 21/02 D7/642
D1,043,269 S * 9/2024 Kong ..... D7/653
D1,071,655 S * 4/2025 Chudikova ..... D7/645
D1,075,437 S * 5/2025 Siskindovich ..... D7/653
2005/0155229 A1 * 7/2005 Lee ..... A47G 21/06 30/322
2016/0374488 A1 * 12/2016 Shapiro ..... A47G 21/04 30/165
2017/0340152 A1 * 11/2017 Lee ..... B26B 3/02
2021/0059444 A1 * 3/2021 Truog ..... A47G 21/02
2022/0338652 A1 * 10/2022 Li ..... A47G 21/04
2023/0284807 A1 * 9/2023 Wong ..... A47G 21/02
2023/0346145 A1 * 11/2023 Navratil ..... A47G 21/02
2024/0215742 A1 * 7/2024 Wong ..... A47G 21/023

FOREIGN PATENT DOCUMENTS

CN 215226627 U * 12/2021 ..... A47G 21/04
GB 82046060004000 11/2019
GB 82051400006000 11/2019
JP D1642762 10/2019
WO D204606004 11/2019

OTHER PUBLICATIONS

Concession Essentials Disposable Wooden Cutlery Spoons, Feb. 8, 2021; https://www.amazon.com/Concession-Essentials-Disposable-Compostable-Friendly/dp/B08WR9WZ45 (Year: 2021), 8 pages.
KingSeal Disposable Birch Wood Cutlery Spoons, Oct. 19, 2019, https://www.amazon.com/KingSeal-Certified-Disposable-Biodegradable-Friendly/dp/B07ZCLDXDM (Year: 2019), 8 pages.
LoengMax Disposable Wooden Spoons, Mar. 25, 2021, https://www.amazon.com/LoengMax-Spoons-100PCS-Length-Wood-Friendly-100-Biodegradabl-Natural/dp/B0912L94NS (Year: 2021), 11 pages.
Palm Naki Birchwood Cutlery, Jan. 8, 2020, https://www.amazon.com/Palm-Naki-Bamboo-Cutlery-Count/dp/B081PDNDJ3 (Year:2020), 11 pages.
Perfect Stix Wooden Cutlery, Jan. 27, 2016, https://www.amazon.com/Perfect-Stix-Green-Spoon-Disposable/dp/B01B4GCOWY (Year:2016), 9 pages.

* cited by examiner

DISPOSABLE PAPER PULP FAST FOOD CUTLERY

TECHNICAL FIELD

The present disclosure relates to cutlery made from a biodegradable pulp material and in particular to a disposable paper pulp fast food fork, a disposable paper pulp fast food spoon, and a disposable paper pulp fast food knife.

BACKGROUND

Disposable cutlery is widely applied in the catering field. Along with development of fast food, tourism and take-out services, the use amount of the disposable cutlery increases dramatically. In the prior art, most of the disposable cutlery are made of plastic or wood. The plastic cutlery may take dozens of years or even several hundred years to degrade, bringing environmental pollution, while the production of the wooden cutlery requires a large number of trees to be felled, which is also unfavorable for environmental improvement.

In recent years, as people have increasing awareness for environmental protection, more and more efforts are made to develop disposable cutlery using a degradable material such as paper pulp or pulp. However, in the prior art, the disposable paper pulp or pulp cutlery generally has a low strength such that they are easy to deform or break in use. Furthermore, in the prior art, some of the disposable paper pulp cutlery are thickened to have an increased strength. In this case, the inconvenience of use is brought, the comfort of use is affected and the production costs are increased.

Chinese utility model patent ZL201922474635.6 discloses a paper-made cutlery and a paper-made cutlery set, and specifically discloses the following: a strength of the cutlery is increased by forming a groove on a holding portion and disposing a reinforcing rib on a connection portion. In use, a functional portion of the cutlery conveys a load to the holding portion along a center axis of the cutlery (i.e., a fork, a spoon, or a knife) after receiving the load, and the middle portion of the holding portion is a thin-walled groove structure, and thus only a flange at the top of the groove is incapable of providing effective support for conveying the load due to a low strength especially in a case of thin wall, thereby bending or twisting the cutlery, and further affecting effective use of the cutlery. Furthermore, the top of the groove has a larger width than the bottom of the groove, and the larger width of the groove means that the strength of the handle at this position is lower. In addition, because the holding portion is recessed in middle and bulged at both sides, stability and comfort in use are affected to some extent.

SUMMARY

The present disclosure aims to provide a disposable paper pulp or pulp fast food fork, where a strength of a handle of the fast food fork can be increased through an undulated curved surface structure, and an integral thin-walled structure of the fast food fork is formed using paper pulp, thereby reducing the production costs and increasing the use comfort; to provide a disposable paper pulp fast food spoon, which can still have good structural strength in a case of small material thickness through disposal of a reinforcing structure, thereby ensuring use comfort of the fast food spoon; and to provide a disposable paper pulp fast food knife, where the entire structural strength of the fast food knife can be increased by a reinforcing structure, thereby ensuring effective use of a thin paper pulp fast food knife.

An aspect of the present disclosure is achieved in the following technical solutions.

Provided is a disposable paper pulp fast food fork, including a handle, a first transition portion and a fork body. An end of the handle is connected to an end of the fork body through the first transition portion to form a fast food fork body, and a plurality of prongs is formed at the other end of the fork body.

Two reinforcing arched strips paralleled to each other along a length direction of the handle are convexly disposed on an upper surface of the handle, and a first reinforcing groove lower than upper surfaces of the reinforcing arched strips is formed between the two reinforcing arched strips; one end of the reinforcing arched strip extends to an end of the handle away from the first transition portion, and the other end of the reinforcing arched strip extends through the first transition portion to the lowest region of the fork body; a second reinforcing groove is formed on each prong, one end of the second reinforcing groove extends to a tip of the prong, and the other end of the second reinforcing groove extends through the lowest region of the fork body to the first transition portion; the reinforcing arched strips, the first reinforcing groove, the prongs and the second reinforcing grooves are disposed in parallel.

The second reinforcing groove on the prong located in middle extends into the first reinforcing groove, and the second reinforcing grooves on several prongs located at both sides of the middle prong are symmetrically distributed at both sides of an end of the first reinforcing groove.

A reinforcing concave surface is formed at a middle portion of an upper surface of the fork body, and the reinforcing concave surface is located at the lowest region of the fork body and in smooth transitional connection with the two reinforcing arched strips.

A third transition portion is formed at each of the ends of the two reinforcing arched strips close to the first transition portion and the reinforcing arched strips are in smooth transitional connection with the reinforcing concave surface of the fork body through the third transition portions.

A downwardly-recessed third reinforcing groove is formed on the upper surface of the handle, one end of the third reinforcing groove extends to an end of the handle away from the first transition portion, and the other end of the third reinforcing groove extends through the first transition portion to the lowest region of the fork body, such that the two reinforcing arched strips are disposed within the third reinforcing grooves.

A second transition portion is formed at each of ends of the two reinforcing arched strips, and the two reinforcing arched strips are in smooth transitional connection with the handle through the second transition portions.

The two reinforcing arched strips are connected with each other through a connection bridge.

The two reinforcing arched strips are connected with each other through a fourth transition portion, the fourth transition portion is a convex arc-surface structure and located at an end of the handle away from the first transition portion, and the fourth transition portion is connected smoothly between the two reinforcing arched strips and the third reinforcing groove of the handle.

The upper surfaces of the two reinforcing arched strips both are inclined surface structures with an angle of inclination being 1.4°-1.6°, a high end of the inclined surface structure is located at an end of the handle away from the first transition portion, and a low end of the inclined surface structure is located at an end of the handle connected with the first transition portion.

The fast food fork body is an integral thin-walled structure with a thickness of 0.6-0.9 mm.

Another aspect of the present disclosure is achieved in the following technical solutions.

Provided is a disposable paper pulp or pulp fast food spoon, including a handle, a transition portion, and a spoon body. An end of the handle is connected with an end of the spoon body through the transition portion to form a fast food spoon body.

A U-shaped recess is formed on an upper surface of the handle, and the U-shaped recess extends from an end of the handle to the transition portion; a double arch reinforcing portion is disposed in the U-shaped recess, and an upper surface of the double arch reinforcing portion is higher than the handle; the double arch reinforcing portion is formed by two paralleled arched strips which are disposed along edges of two sides of the U-shaped recess respectively, a nesting groove is formed between the two arched strips, and an undulant curved surface structure is formed between the two arched strips, the nesting groove, the U-shaped recess and the handle; an end of the arched strip extends to an end of the U-shaped recess and the other end of the arched strip extends toward the lowest region of the spoon body through the transition portion.

The nesting groove is disposed along a center axis of the handle, a connection bridge is disposed in the nesting groove, and one or more connection bridges are connected between the two arched strips respectively.

An upper surface of the arched strip is an inclined surface structure with an angle of inclination being 1.0°-1.6°, an inclined surface high end of the arched strip is located at an end of the handle away from the transition portion, and an inclined surface low end of the arched strip is located at an end of the handle close to the transition portion.

A first smooth transition portion is formed at the inclined surface high end of the arched strip, and the inclined surface high end of the arched strip is in smooth transitional connection with an end of the handle through the first smooth transition portion.

A second smooth transition portion is formed at the inclined surface low end of the arched strip and is in smooth transitional connection with the spoon body through the transition portion.

A third smooth transition portion is formed at an end of the double arch reinforcing portion, and the inclined surface high ends of the two arched strip are in smooth transitional connection with an end of the handle through the third smooth transition portion.

The handle, the transition portion, the spoon body and the double arch reinforcing portion are formed into an integral thin-walled fast food spoon through paper pulp solidification.

The upper surface of the handle, an upper surface of the transition portion and an upper surface of the spoon body are located in a same plane; an end of the U-shaped recess of the handle is in smooth transitional connection with the upper surface of the handle, the other end of the U-shaped recess is in smooth transitional connection with the transition potion, and the transition portion is in smooth transitional connection with the spoon body.

The integral thin-walled fast food spoon has a thickness of 0.6-0.9 mm

Still another aspect of the present disclosure is achieved in the following technical solutions.

Provided is a paper pulp or pulp fast food knife including a handle and a knife body. The knife body is connected to an end of the handle, and the handle and the knife body both are located in a same plane to form a fast food knife body.

A downwardly-recessed first groove body is formed on an upper surface of the fast food knife body and extends from an end of the handle to a middle portion of the knife body. Two knife body reinforcing ribs are convexly disposed in the first groove body and extend from an edge of an end of the handle to the knife body. The two knife body reinforcing ribs are disposed in parallel along a length direction of the handle, and a downwardly-recessed reinforcing groove is formed between the two knife body reinforcing ribs. A downwardly-recessed second groove body is formed on an upper surface of the knife body. One end of the second groove body is in smooth transitional connection with the first groove body, and the other end of the second groove body extends to a tip of the knife body along a length direction of the knife body.

An end of the knife body reinforcing rib away from a cutting edge extends to a connection position of the first groove body and the second groove body.

Upper surfaces of the two knife body reinforcing ribs are inclined surface structures higher than an upper surface of the handle. A high end of the inclined surface structure is located at an end of the handle, and a low end of the inclined surface structure is located on the knife body.

The inclined surface structures of the two knife body reinforcing ribs have an angle of inclination of 1.4°-1.6°.

A first transition portion is formed at the high ends of the inclined surface structures of the two knife body reinforcing ribs, and a second transition portion is formed at the low ends of the inclined surface structures of the two knife body reinforcing ribs. The knife body reinforcing ribs are in smooth transitional connection with the first groove body through the first transition portion, and the knife body reinforcing ribs are in smooth transitional connection with the knife body through the second transition portion.

The first transition portion includes two strip-shaped first unit transition portions such that each of the knife body reinforcing ribs is connected with the first unit transition portion to form an elongated reinforcing rib parallel to the length direction of the handle.

A connection bridge is disposed between the two elongated reinforcing ribs and located in the reinforcing groove.

The first transition portion is an arc-surface structure such that the first transition portion is in smooth transitional connection with the two knife body reinforcing ribs and the first groove body.

The second transition portion comprises two strip-shaped second unit transition portions such that each of the knife body reinforcing ribs is connected with the second unit transition portion to form an elongated reinforcing rib parallel to the length direction of the handle, wherein one elongated reinforcing rib is in smooth transitional connection with the first groove body and the other elongated reinforcing rib is in smooth transitional connection with the first groove body and the second groove body.

The disposable paper pulp fast food knife is an integral thin-walled structure formed through paper pulp solidification, and has a thickness of 0.6-0.9 mm Compared with the prior art, the present disclosure has the following beneficial effects.

1. In an aspect of the present disclosure, two reinforcing arched strips are convexly disposed on the handle and the first reinforcing groove is formed between the two reinforcing arched strips, such that a bending strength of the handle can be increased by use of the two paralleled reinforcing arched strips, and bending strength and torsional strength of the handle both can be improved by use of the undulated curved surface structure. In this way, deformation of the handle of the fast food fork under a force is avoided and its nesting with the cutlery of same specifications is facilitated at the same time.

2. In an aspect of the present disclosure, the second reinforcing grooves are disposed on the prongs, the second reinforcing grooves are partially overlapped with the first reinforcing groove, and a reinforcing concave surface is disposed on the fork body. In this case, the strength of the fork body is increased and a load can be transferred easily from the fork body to the handle, thus improving the entire structural strength of the fast food fork and effectively avoiding the deformation of the fork body of the fast food fork under a force.

3. In an aspect of the present disclosure, the connection bridge, the second transition portion, the third transition portion and the fourth transition portion are disposed selectively on the reinforcing arched strips of the handle, such that the structural strength and the comfort of the handle are further improved. Further, information such as cavity position number can be printed conveniently.

4. In an aspect of the present disclosure, the fast food fork is formed integrally through paper pulp solidification. Thus, the fork is easy in mold opening and process operation, simple in structure, small in volume and light in weight and can be manufactured in mass production. As a result, the forks can be widely applied in fast food delivery.

5. In an aspect of the present disclosure, the strength of the handle of the fast food fork can be increased by the undulated curved surface structure formed of the handle, the third reinforcing groove, the reinforcing arched strips and the first reinforcing groove, and the structural strength of the fork body can be increased by the second reinforcing grooves and the reinforcing concave surface. Thus, an integral thin-walled structure of the fast food fork can be formed using paper pulp, thus reducing the production costs. Furthermore, the nesting packaging of the fast food forks is facilitated and the holding comfort of the fast food forks is guaranteed.

6. In another aspect of the present disclosure, the double arch reinforcing portion formed by two paralleled arched strips disposed along a length direction of the handle is provided to resist the bending. Further, the smooth transition portions further increase connection strength between the arched strips and the entire structure of the fast food spoon, thus effectively avoiding deformation of the fast food spoon resulted from a force.

7. In another aspect of the present disclosure, a connection bridge is formed between two arched strips to achieve the purpose of resisting a twist so as to further improve the strength of the handle and the holding comfort. Furthermore, mutual nesting of different spoons can be facilitated and information such as cavity position number can be printed.

8. In another aspect of the present disclosure, the undulant curved surface structure is formed by two arched strips, the U-shaped recess and the nesting groove to achieve symmetrical design. Thus, the handle has a higher strength than a handle having a plane structure and can effectively prevent deformations such as bending and twist. In this way, a thin fast food spoon can be manufactured while ensuring the structural strength, thereby reducing production cost, storage cost and transportation cost.

9. In another aspect of the present disclosure, due to integral paper pulp solidification, it is easy to perform mold opening and process operations, thus simplifying the structure and facilitating mass production.

10. In another aspect of the present disclosure, the disposal of the two parallel arched strips enables the fast food spoon to have good structural strength in a case of small material thickness. Furthermore, by use of the smooth transition portions at both ends of the arched strips and the nesting groove, the overall strength of the fast food spoon is further increased and the use comfort of the fast food spoon is guaranteed.

11. In still another aspect of the present disclosure, two knife body reinforcing ribs are disposed, the reinforcing groove is formed between the two knife body reinforcing ribs, and the two knife body reinforcing ribs are convexly disposed on the first groove body of the handle. In this case, an undulated curved surface structure is formed on the handle. Compared with a planar structure, the handle has higher strength, thus leading to better bending strength and better torsional strength. In this way, the effective use of the thin-walled paper pulp fast food knife is guaranteed.

12. In still another aspect of the present disclosure, due to disposal of the second groove body, the first groove body and two parallel knife body reinforcing ribs, a load on the knife body can be transferred along a direction of the handle. In this case, the fast food knife can receive a force uniformly, and deformation or the like occurring to the fast food knife in use can be avoided. The fast food knife can still work normally even in a case of small thickness.

13. In still another aspect of the present disclosure, with disposal of the reinforcing structures such as the transition portion and the connection bridge, the entire structural strength of the fast food knife can be further increased to facilitate transfer of a load and the external appearance of the fast food knife is made more beautiful.

14. In still another aspect of the present disclosure, with disposal of the knife body reinforcing ribs and the reinforcing groove, nesting packaging of the cutlery of the same specifications can be facilitated for ease of use. Further, the present disclosure is small in volume and light in weight, and thus can be easily promoted, thereby bringing good economic benefits.

15. In still another aspect of the present disclosure, the strength of the handle and the knife body can be increased by forming an undulated curved surface structure on the fast food knife, and a load can be transferred from the knife body to the handle through the first groove body, the second groove body and the knife body reinforcing ribs. With disposal of the reinforcing structures, the entire structural strength of the thin-walled paper pulp fast food knife can be increased and the holding comfort is improved, thereby ensuring the effective use of the fast food knife.

BRIEF DESCRIPTIONS OF THE DRAWINGS

Numerals of the drawings are described as follows: 101 handle, 111 reinforcing arched strip, 112 first reinforcing groove, 113 connection bridge, 114 third reinforcing groove, 115 second transition portion, 116 third transition portion, 117 fourth transition portion, 102 first transition portion, 103 fork body, 131 prong, 132 second reinforcing groove, 133 reinforcing concave surface, 201 handle, 211 U-shaped recess, 202 transition portion, 203 spoon body, 204 double arch reinforcing portion, 241 arched strip, 2411 first smooth transition portion, 2412 second smooth transition portion, 242 nesting groove, 243 connection bridge, 244 third smooth transition portion, 301 handle, 302 knife body, 303 first groove body, 304 knife body reinforcing rib, 341 reinforcing groove, 342 first transition portion, 343 second transition portion, 344 connection bridge, and 305 second groove body.

DETAILED DESCRIPTIONS OF EMBODIMENTS

The present disclosure will be further described below in combination with the accompanying drawings and the specific embodiments.

Figure 1:
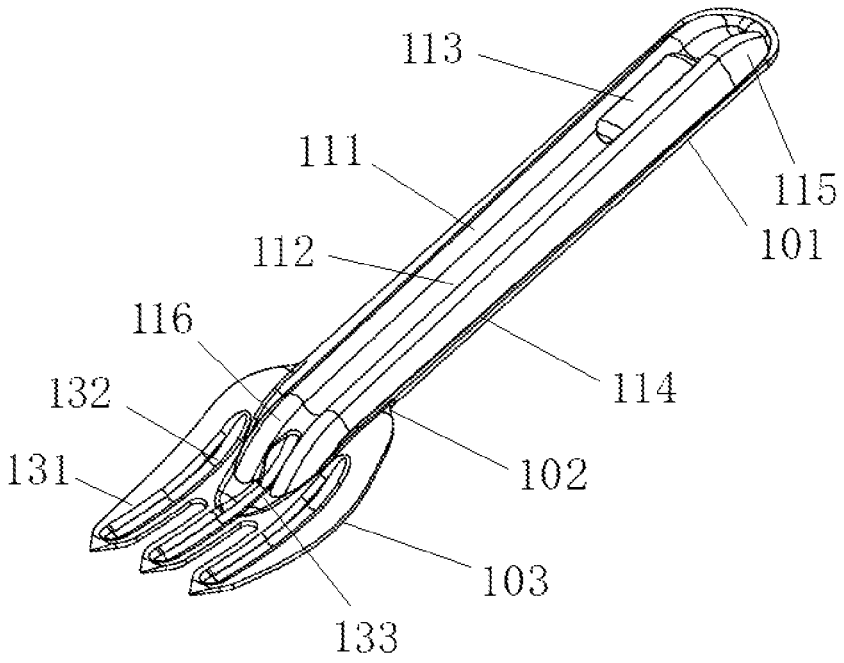
FIG. 1 is a perspective view of a disposable paper pulp fast food fork according to an embodiment 1-1 of the present disclosure.
Figure 7:
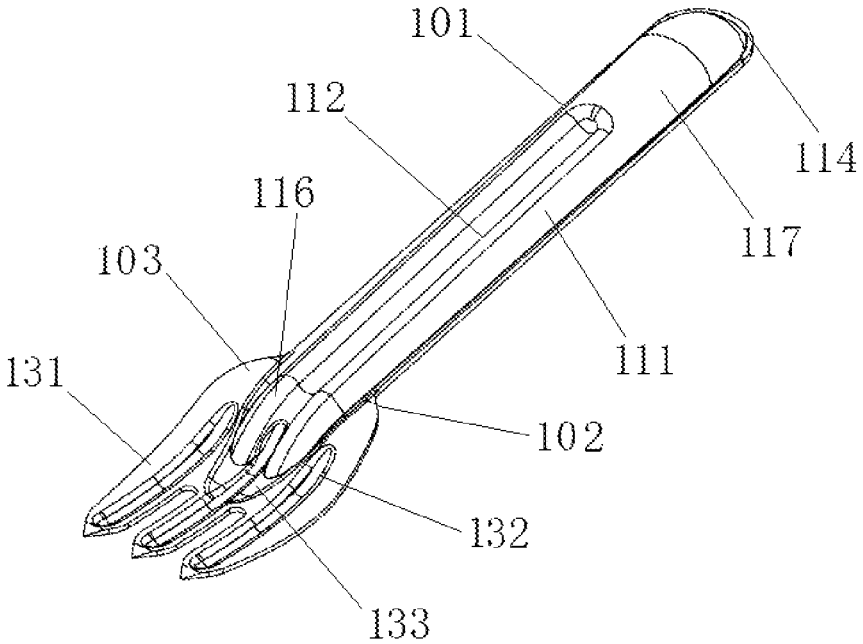
FIG. 7 is a perspective view of a disposable paper pulp fast food fork according to an embodiment 1-2 of the present disclosure.

As shown in FIGS. 1 and 7, provided is a disposable paper pulp fast food fork. The disposable paper pulp fast food fork includes a handle 101, a first transition portion 102, and a fork body 103. An end of the handle 101 is connected to an end of the fork body 103 through the first transition portion 102 to form a fast food fork body, and a plurality of prongs 131 are formed at the other end of the fork body 103.

Figure 4:
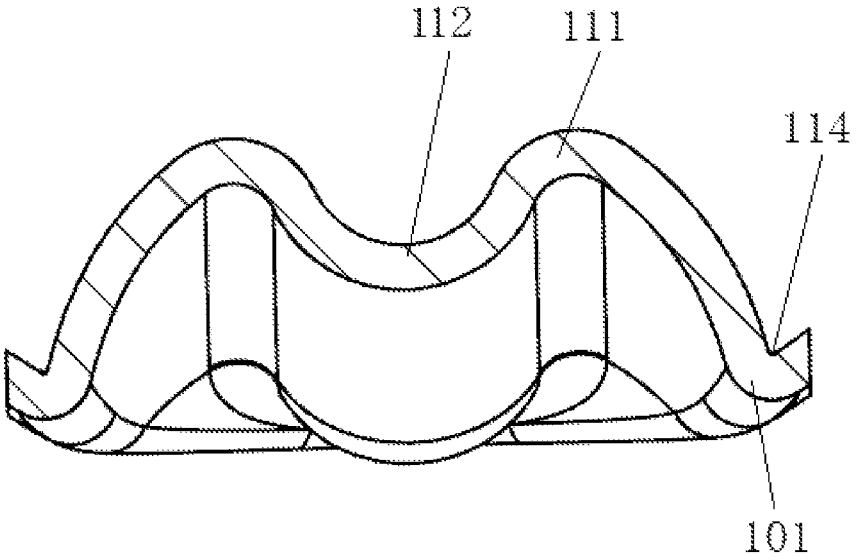
FIG. 4 is an enlarged sectional view taken along a line A-A in FIG. 2.
Figure 10:
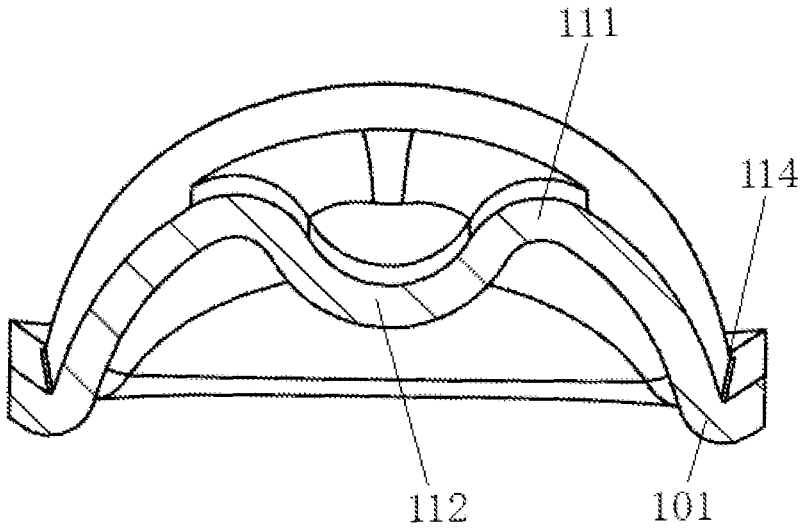
FIG. 10 is an enlarged sectional view taken along a line E-E in FIG. 8.

As shown in FIGS. 1-3, 7 and 8, two reinforcing arched strips 111 paralleled to each other along a length direction of the handle 101 are convexly disposed on an upper surface of the handle 101, and a first reinforcing groove 112 lower than upper surfaces of the reinforcing arched strips 111 is formed between the two reinforcing arched strips 111 as shown in FIGS. 4 and 10. An undulated curved surface structure is formed among the two reinforcing arched strips 111, the first reinforcing groove 112 and the handle 101 and has a higher strength to increase a bending strength and a torsional strength of the handle 101 effectively as compared with a planar structure of the handle 101. The inverse W-shaped structure formed by the two reinforcing arched strips 111 and the first reinforcing groove 112 can enable the handle 101 to have nesting function so as to facilitate nesting of fast food forks of the same specifications. One end of the reinforcing arched strip 111 extends to an end of the handle 101 away from the first transition portion 102, and the other end of the reinforcing arched strip 111 extends through the first transition portion 102 to the lowest region of the fork body 103. As clearly shown in FIG. 1, for example, the two reinforcing arched strips 111 and the first reinforcing groove 112 form a double arch reinforcing structure or portion. More specifically, the handle 101 includes a first double arch reinforcing structure disposed between two curved lateral edge portions of the handle 101 and extending along a length of the handle 101. The first transition portion 102 includes a second double arch reinforcing structure extending from the first double arch reinforcing structure and toward the fork body 103. The fork body 103 includes a third double arch reinforcing structure extending from the second double arch reinforcing structure and toward a lowest region of the fork body 103. The first double arch reinforcing structure, the second double arch reinforcing structure, and the third double arch reinforcing structure form a single one double arch reinforcing structure. A second reinforcing groove 132 is formed on each prong 131, one end of the second reinforcing groove 132 extends to a tip of the prong 131, and the other end of the second reinforcing groove 132 extends through the lowest region of the fork body 103 to the first transition portion 102. The disposal of the second reinforcing grooves 132 increases the strength of the prongs 131 to guarantee normal use of the prongs 131. The reinforcing arched strips 111, the first reinforcing groove 112, the prongs 131 and the second reinforcing grooves 132 are disposed in parallel to facilitate transfer of a load and ensure the entire structural strength of the fast food fork body.

The second reinforcing groove 132 on the prong 131 located in middle extends into the first reinforcing groove 112, and the second reinforcing grooves 132 on several prongs 131 located at both sides of the middle prong 131 are symmetrically distributed at both sides of an end of the first reinforcing groove 112. The prongs 131 transfers a load to the reinforcing arched strips 111 and the first reinforcing groove 112 through the second reinforcing grooves 132, and the entire structural strength of the fork body 103 is guaranteed by use of the symmetrically-arranged second reinforcing grooves 132. In this way, the use process of the fork body 103 is guaranteed.

Figure 2:
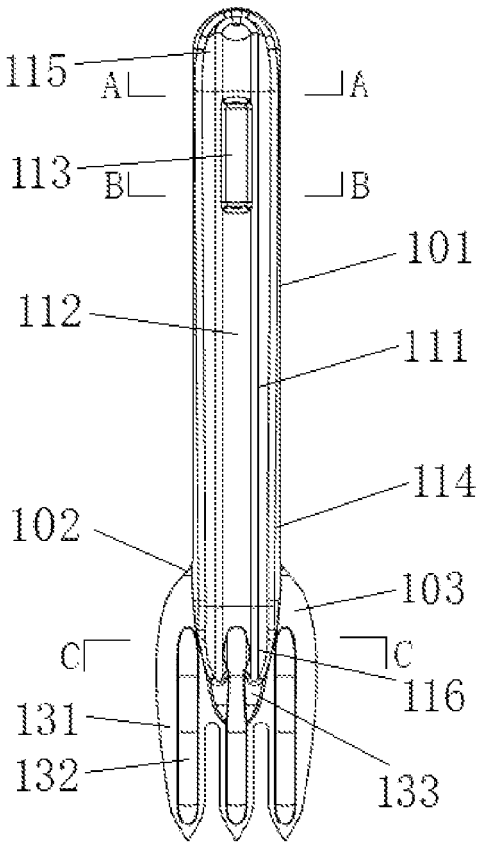
FIG. 2 is a front view of a disposable paper pulp fast food fork according to an embodiment 1-1 of the present disclosure.
Figure 3:
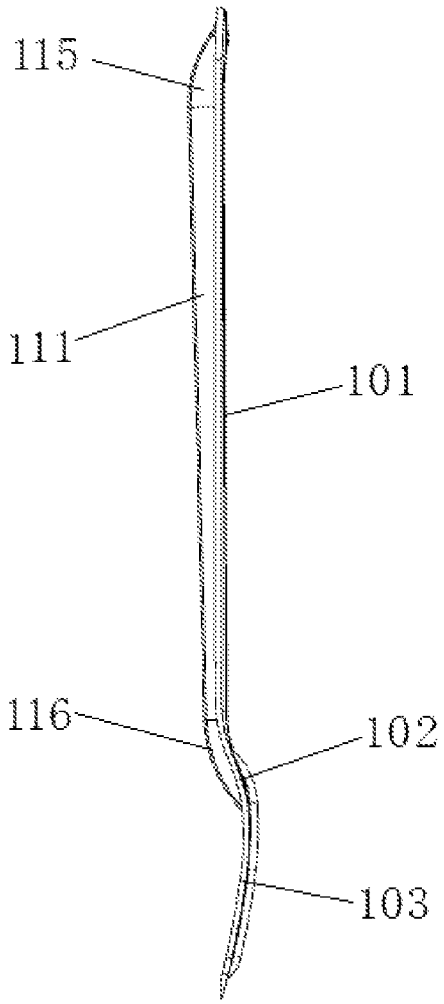
FIG. 3 is a side view of a disposable paper pulp fast food fork according to an embodiment 1-1 of the present disclosure.
Figure 6:
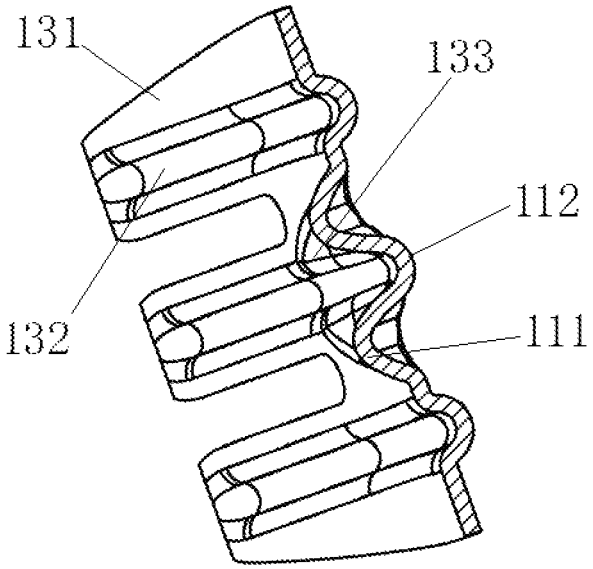
FIG. 6 is an enlarged sectional view taken along a line C-C in FIG. 2.

As shown in FIGS. 1, 2 and 6, a reinforcing concave surface 133 is formed at a middle portion of an upper surface of the fork body 103, and the reinforcing concave surface 133 is located at the lowest region of the fork body 103 and in smooth transitional connection with the two reinforcing arched strips 111. The disposal of the reinforcing concave surface 133 further improves a deformation resistance of the fork body 103 under a force, thus facilitating transfer of a load from the prongs to the two reinforcing arched strips 111.

Figure 5:
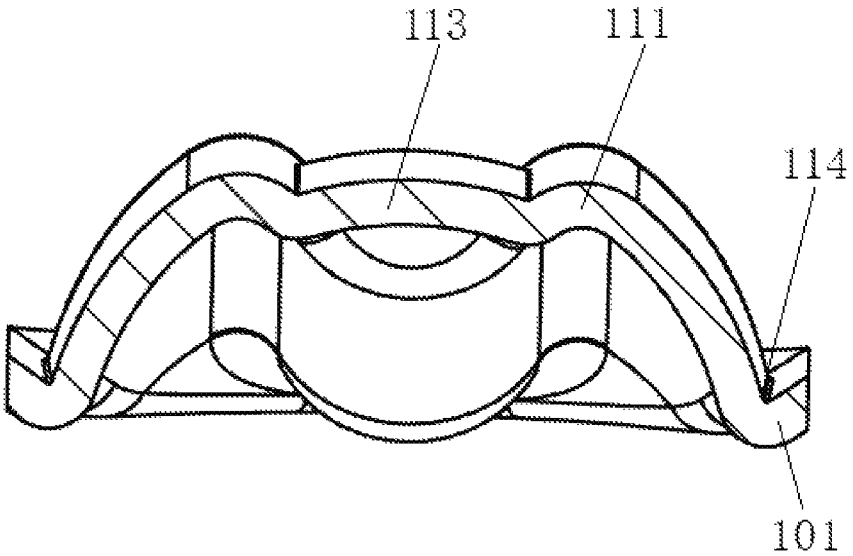
FIG. 5 is an enlarged sectional view taken along a line B-B in FIG. 2.

As shown in FIGS. 4 and 5, a downwardly-recessed third reinforcing groove 114 is formed on the upper surface of the handle 101, in each lateral edge portion of the handle 101, one end of the third reinforcing groove 114 extends to an end of the handle 101 away from the first transition portion 102, and the other end of the third reinforcing groove 114 extends through the first transition portion 102 to the lowest region of the fork body 103, such that the two reinforcing arched strips 111 are disposed within the third reinforcing grooves 114. In a sense, the third reinforcing grooves 114 of the handle 101 form the two curved lateral edge portions of the handle, respectively. The disposal of the two reinforcing arched strips 111 together with the third reinforcing groove 114 presents beautiful appearance and increases a connection strength between the reinforcing arched strips 111 and the handle 101 as well as bending strength and torsional strength of the handle 101.

A second transition portion 115 is formed at each of ends of the two reinforcing arched strips 111, and the two reinforcing arched strips 111 are in smooth transitional connection with the third reinforcing groove 114 of the handle 101 through the second transition portions 115. The disposal of the second transition portions 115 beautifies the external appearance of the handle 101, facilitates transfer of a load at the top end of the reinforcing arched strips 111 and increases the structural strength of the end of the reinforcing arched strips 111.

A third transition portion 116 is formed at each of the ends of the two reinforcing arched strips 111 close to the first transition portion 102, and the reinforcing arched strips 111 are in smooth transitional connection with the reinforcing concave surface 133 of the fork body 103 through the third transition portions 116. The disposal of the third transition portions 116 beautifies the external appearance of the handle 101, facilitates transfer of a load at the bottom end of the reinforcing arched strips 111 and increases the structural strength of the end of the reinforcing arched strips 111.

As shown in FIG. 5, the two reinforcing arched strips 111 are connected with each other through a connection bridge 113. One or more connection bridges 113 may be disposed. When one connection bridge 113 is disposed, the connection bridge 113 is disposed at an end of the handle 101 away from the first transition portion 102, so as to improve the entire strength and the holding comfort of the handle 101. When two or more connection bridges 113 are disposed, the connection bridges 113 may be spaced apart. The connection bridge 113 and the two reinforcing arched strips 111 form an approximate plane to increase the holding convenience and comfort. Furthermore, information such as cavity position number may be printed thereon to facilitate quality inspection and mold replacement and the like during batch production.

Figure 8:
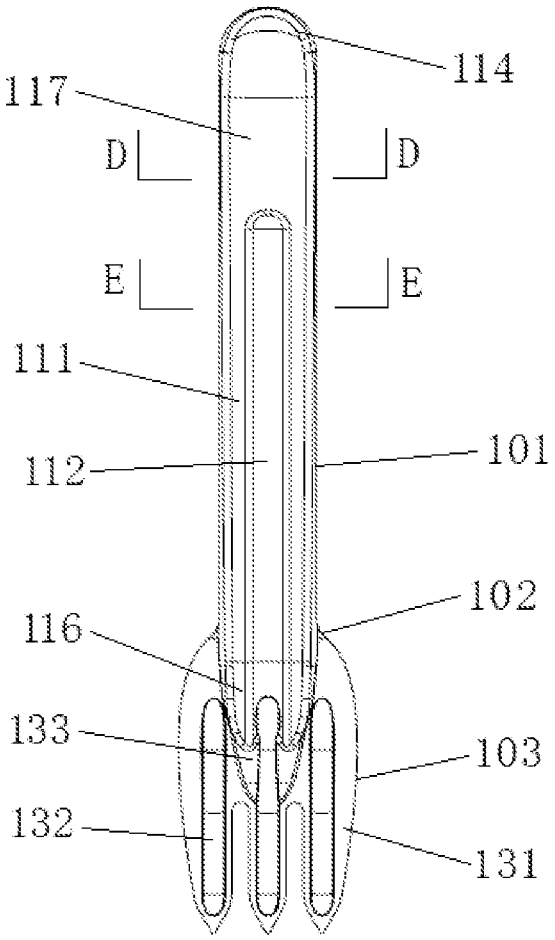
FIG. 8 is a front view of a disposable paper pulp fast food fork according to the embodiment 1-2 of the present disclosure.
Figure 9:
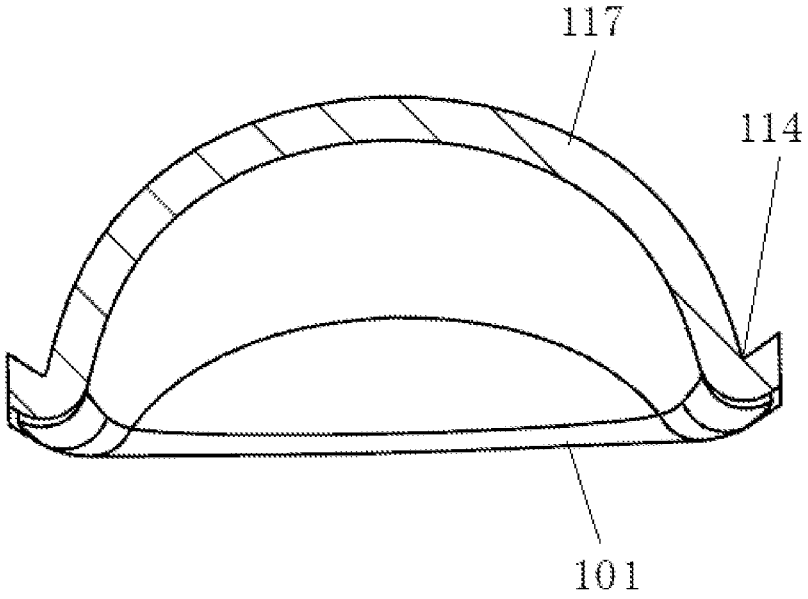
FIG. 9 is an enlarged sectional view taken along a line D-D in FIG. 8.

As shown in FIGS. 8 and 9, the two reinforcing arched strips 111 are connected with each other through a fourth transition portion 117, and the fourth transition portion 117 is a convex arc-surface structure and located at an end of the handle 101 away from the first transition portion 102. The fourth transition portion 117 is connected smoothly between the two reinforcing arched strips 111 and the third reinforcing groove 114 of the handle 101. Similar to the connection bridge 113, the fourth transition portion 117 can not only increase the structural strength of the top end of the handle 101 but also improve the aesthetics and the holding comfort of the handle 101.

The upper surfaces of the two reinforcing arched strips 111 both are inclined surface structures with an angle of inclination being 1.4°-1.6°. A high end of the inclined surface structure is located at an end of the handle 101 away from the first transition portion 102, and a low end of the inclined surface structure is located at an end of the handle 101 connected with the first transition portion 102. The inclined surface structures of the reinforcing arched strips 111 increase the structural strength of the distal end of the handle 101 to ensure normal use of the handle 101 and also improve the holding comfort and the external aesthetics to some extent.

The fast food fork body is an integral thin-walled structure with a thickness of 0.6-0.9 mm The undulated reinforcing structure ensures the entire structural strength of the thin-walled fast food fork body. The fast food fork body is used together with spoon and knife and has the same structure in handle as the spoon and knife. Therefore, the fast food fork body can be nested with the spoon and knife sequentially through the handle 101 to form a cutlery combination. The cutlery combination with integral thin-walled structure is smaller in volume and therefore widely applied in the fast food delivery of trains, airplanes and the like.

Embodiment 1-1

As shown in FIGS. 1-6, the handle 101, the first transition portion 102 and the fork body 103 form the fast food fork body, and three prongs 131 are formed uniformly on the fork body 103. The reinforcing concave surface 133 is formed at the middle portion of the fork body 103. The second reinforcing groove 132 is formed at each of the three prongs 131, the three second reinforcing grooves 132 are paralleled to each other, and the second reinforcing groove 132 located in middle penetrates through the reinforcing concave surface 133.

The third reinforcing groove 114 is formed downwardly along an edge of the upper surface of the handle 101 and extends from the top end of the handle 101 to the fork body 103. Two reinforcing arched strips 111 with an angle of inclination being 1.5° are convexly disposed within the third reinforcing grooves 114. The two reinforcing arched strips 111 are disposed in parallel and form the first reinforcing groove 112. Further, the first reinforcing groove 112 may also be used a nesting groove to facilitate nesting packaging of the cutlery having the handle 101 of the same specifications. The second reinforcing groove 132 located in middle extends into the first reinforcing groove 112. One connection bridge 103 is disposed at an upper part of the first reinforcing groove 112. The connection bridge 103 is connected between the two reinforcing arched strips 111 and a cavity position number may be printed thereon. Ends of the two reinforcing arched strips 111 are in smooth transitional connection with the third reinforcing groove 114 through the second transition portions 115 respectively, and other ends of the two reinforcing arched strips 111 are in smooth transitional connection with the reinforcing concave surface 133 of the fork body 103 through the third transition portions 116 respectively.

In this embodiment, an integral thin-walled structure with a thickness of 0.60 mm is formed through one-time solidification of a degradable paper pulp.

Embodiment 1-2

As shown in FIGS. 7-10, the handle 101, the first transition portion 102 and the fork body 103 form the fast food fork body, and three prongs 131 are formed uniformly on the fork body 103. The reinforcing concave surface 133 is formed on the middle portion of the fork body 103. The second reinforcing groove 132 is formed on each of the three prongs 131, the three second reinforcing grooves 132 are paralleled to each other, and the second reinforcing groove 132 located in middle penetrates through the reinforcing concave surface 133.

Embodiment 2-1

The third reinforcing groove 114 is formed downwardly along an edge of the upper surface of the handle 101 and extends from the top end of the handle 101 to the fork body 103. Two reinforcing arched strips 111 with an angle of inclination being 1.6° are convexly disposed within the third reinforcing grooves 114. The two reinforcing arched strips 111 are disposed in parallel and form the first reinforcing groove 112. Further, the first reinforcing groove 112 may also be used a nesting groove to facilitate nesting packaging of the cutlery having the handle 101 of the same specifications. The second reinforcing groove 132 located in middle extends into the first reinforcing groove 112. One connection bridge 103 is disposed at an upper part of the first reinforcing groove 112. The connection bridge 103 is connected between the two reinforcing arched strips 111 and a cavity position number may be printed thereon. Ends of the two reinforcing arched strips 111 are in smooth transitional connection with the third reinforcing groove 114 through the fourth transition portions 117 respectively, and other ends of the two reinforcing arched strips 111 are in smooth transitional connection with the reinforcing concave surface 133 of the fork body 103 through the third transition portions 116 respectively.

In this embodiment, an integral thin-walled structure with a thickness of 0.75 mm is formed through one-time solidification of a degradable paper pulp.

Spoon

Embodiment 2-1

Figure 11:
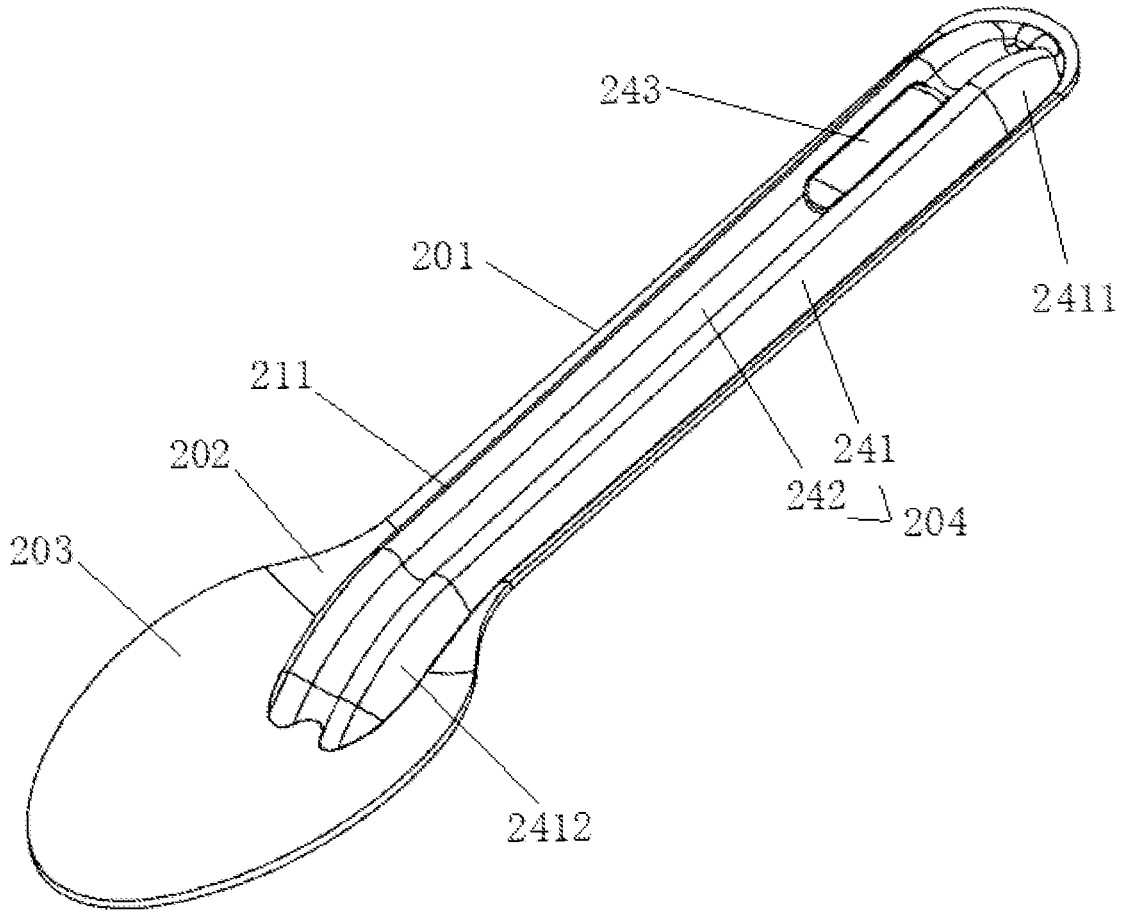
FIG. 11 is a stereoscopic diagram of a disposable paper pulp fast food spoon according to the present disclosure.

With reference to FIG. 11, there is provided a disposable paper pulp fast food spoon, including a handle 201, a transition portion 202 and a spoon body 203. An end of the handle 201 is connected with an end of the spoon body 203 through the transition portion 202 to form a fast food spoon body.

Figure 12:
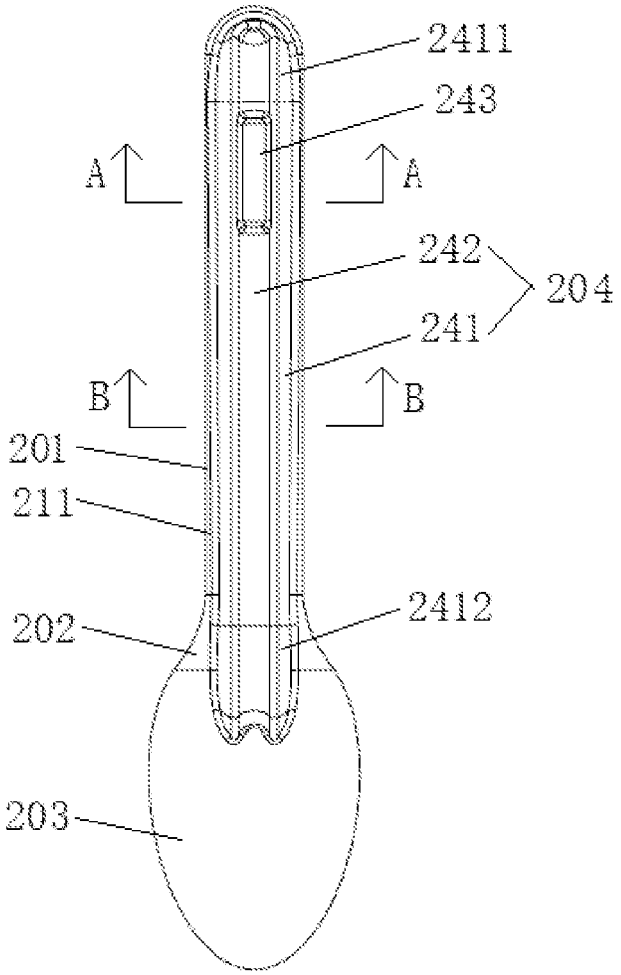
FIG. 12 is a front view of a disposable paper pulp fast food spoon according to the present disclosure.
Figure 13:
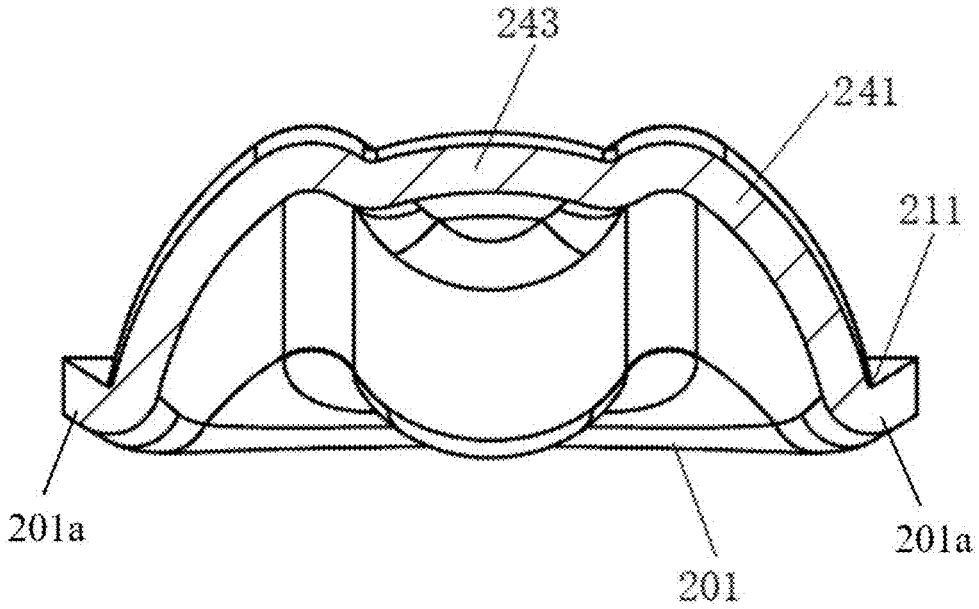
FIG. 13 is an enlarged sectional view taken along A-A in FIG. 12, wherein the disposable paper pulp fast food spoon is considered in an upright position.
Figure 14:
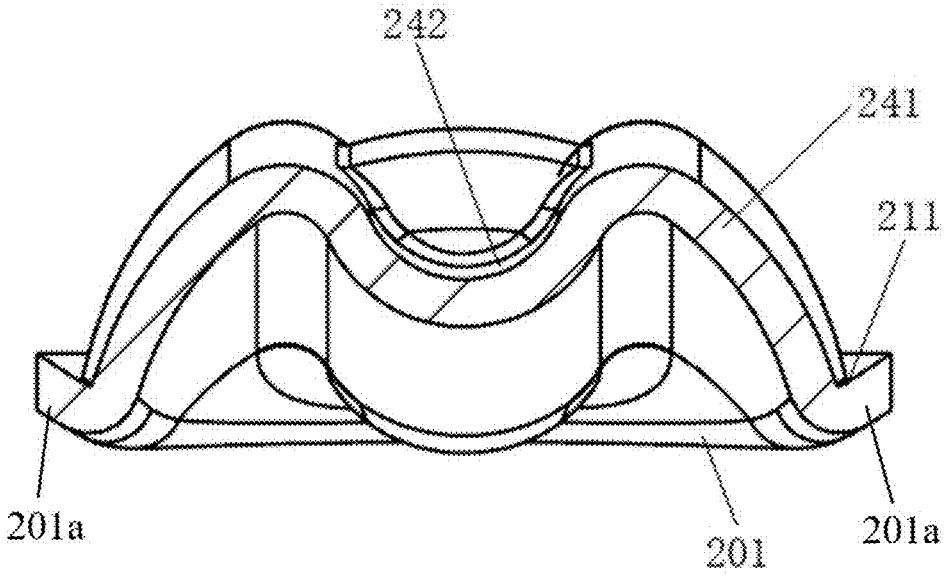
FIG. 14 is an enlarged sectional view taken along B-B in FIG. 12, wherein the disposable paper pulp fast food spoon is considered in the upright position.

As shown in FIGS. 12-14, the handle 201 has two curved lateral edge portions 201*a*. A U-shaped recess 211 is formed on an upper surface of the handle 201, and the U-shaped recess 211 extends from an end of the handle 201 to the transition portion 202; a double arch reinforcing portion or structure 204 is disposed in the U-shaped recess 211, and an upper surface of the double arch reinforcing portion 204 is higher than the handle 201; the double arch reinforcing portion 204 is formed by two paralleled arched strips 241 which are disposed along edges of two sides of the U-shaped recess 211 respectively, and a nesting groove 242 is formed between the two arched strips 241. The groove-shaped structure of the nesting groove 242 can not only enable the handle 201 to have a nesting function but also increase a strength of the handle 201. An undulant curved surface structure is formed between the two arched strips 241, the nesting groove 242, the U-shaped recess 211 and the handle 201. An end of the arched strip 241 extends to an end of the U-shaped recess 211 and the other end of the arched strip 241 extends toward the lowest region of the spoon body 203 through the transition portion 202. Preferably, the other end of the arched strip 241 extends to be close to but not over the lowest position of the spoon body 203. Two parallel arched strips 241 can effectively improve the structural strength of the body of the fast food spoon, facilitate transfer of a load and enable the body of the fast food spoon to receive uniform force. The other end of the arched strip 241 may also extend slightly over the curved surface lowest position of the spoon body 203, thereby ensuring the structural strength of the spoon body 203. In other words, the handle 201 includes a first double arch reinforcing structure disposed between the two curved lateral edge portions 201*a* and extending along a length of the handle 201. The transition portion 202 includes a second double arch reinforcing structure extending from the first double arch reinforcing structure and toward the spoon body 203. The spoon body includes a third double arch reinforcing structure extending from the second double arch reinforcing structure and toward a lowest region of the spoon body 203. As shown in FIG. 11, for example, the first double arch reinforcing structure, the second double arch reinforcing structure, and the third double arch reinforcing structure form a single one double arch reinforcing structure.

The nesting groove 242 is disposed along a center axis of the handle 201, a connection bridge 243 is disposed in the nesting groove 242, and one or more connection bridges 243 are connected between the two arched strips 241 respectively. The disposal of one or more connection bridges 243 can further increase the structural strength of the handle 201, thus avoiding twist of the handle 201. Further, a plane structure or an approximate plane structure formed by the connection bridge 243 and the two arched strips 241 can effectively improve the gripping comfort and stability. In addition, the information such as cavity position number, trademark and patent number can be printed on a surface of the connection bridge 243. The number of the connection bridges 243 may be determined based on a length of the handle 201. If the handle 201 is short, for example, the handle of an ice cream spoon is short, the connection bridge 243 may not be disposed. If the handle 201 is long, for example, the handle of an ice spoon is long, one connection bridge 243 may be disposed or two to three connection bridges 243 may be disposed in a spacing, so as to ensure anti-bending and anti-twisting effect of the handle 201.

Figure 15:
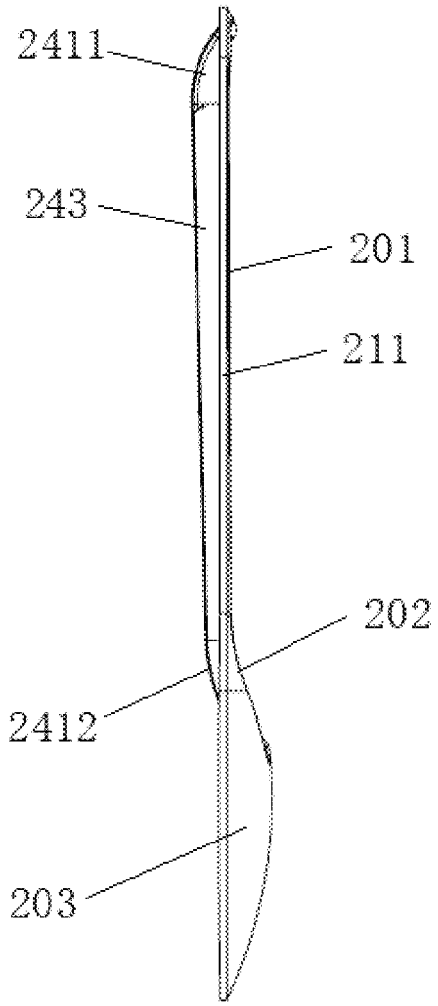
FIG. 15 is a side view of a disposable paper pulp fast food spoon according to the present disclosure.

As shown in FIG. 15, an upper surface of the arched strip 241 is an inclined surface structure. An angle of inclination of the inclined surface structure may be set to 1.0°-1.6° based on the length of the handle 201. An inclined surface high end of the arched strip 241 is located at an end of the handle 201 away from the transition portion 202, and an inclined surface low end of the arched strip 241 is located at an end of the handle 201 close to the transition portion 202. The inclined surface structure of the arched strip 241 increases the structural strength of the distal end of the handle 201 to ensure normal use of the handle 201 and also improves the gripping comfort and external aesthetics to some extent.

A first smooth transition portion 2411 is formed at the inclined surface high end of the arched strip 241, and the inclined surface high end of the arched strip 241 is in smooth transitional connection with an end of the handle 201 through the first smooth transition portion 2411. The disposal of the first smooth transition portion 2411 improves the structural aesthetics of the handle 201, and a radian of the first smooth transition portion 2411 can convey a load better, thus facilitating increasing the overall strength of the fast food spoon.

A second smooth transition portion 2412 is formed at the inclined surface low end of the arched strip 241 and is in smooth transitional connection with the spoon body 203 through the transition portion 202. The second smooth transition portion 2412 extends to be close to the lowest region of the spoon body 203. With disposal of the second smooth transition portion 2412, the strength of the spoon body 203 can be increased and the structural aesthetics of the handle 201 can be improved. Furthermore, a radian of the second smooth transition portion 2412 can convey a load better so as to help increase the overall strength of the fast food spoon.

A third smooth transition portion 244 is formed at an end of the double arch reinforcing portion 204, and the inclined surface high ends of the two arched strip 241 are in smooth transitional connection with an end of the handle 201 through the third smooth transition portion 244. With disposal of the third smooth transition portion 244, the structural strength and aesthetics of the handle 201 can be improved and a good gripping comfort can also be provided. Furthermore, information such as cavity position number may be printed on a front or back face of the third smooth transition portion 244 to promote quality inspection and mold change and the like during mass production.

The upper surface of the handle 201, an upper surface of the transition portion 202 and an upper surface of the spoon body 203 are located basically in a same plane, such that an occupation space of the fast food spoon can be reduced on the basis of ensuring the strength of the fast food spoon, helping packaging and transportation of fast foods as well as stacking of the fast food spoons.

The handle 201, the transition portion 202, the spoon body 203 and the double arch reinforcing portion 204 are formed into an integral thin-walled fast food spoon through paper pulp solidification, thus facilitating mold opening and process operations.

The integral thin-walled fast food spoon has a thickness of 0.6-0.9 mm Due to the small thickness, the volume and weight of the fast food spoon can be reduced and the production cost is lowered. With disposal of the reinforcing structure such as the double arch reinforcing portion 204, it is guaranteed that the fast food spoon can still have good structural strength in a case of small material thickness and can be used normally.

An end of the U-shaped recess 211 is in smooth transitional connection with the upper surface of the handle 201, the other end of the U-shaped recess 211 is in smooth transitional connection with the transition potion 202, and the transition portion 202 is in smooth transitional connection with the spoon body 203. The smooth connection of the handle 201, the transition portion 202 and the spoon body 203 helps to effectively convey a load.

The disposable paper pulp fast food spoon according to the present disclosure may be used separately or together with other cutlery such as knife and fork. The handles of the knife and the fork may be manufactured into the same structure as the handle 201 of the present disclosure, such that the fast food spoon, the knife and the fork can be nested together in sequence through the handle 201 to form a disposable cutlery combination which features small volume and light weight and thus can be used in food delivery field of airplane, train and the like.

As shown in FIG. 11, the handle 201, the transition portion 202 and the spoon body 203 form a fast food spoon body which has a total length of 135 mm The U-shaped recess 211 is formed downwardly along an edge on an upper surface of the handle 201, a distance from the U-shaped recess 211 to the edge of the handle 201 is about 0.5 mm, and the U-shaped recess 211 extends to the transition portion 202. The double arch reinforcing portion 204 formed by two arched strips 241 is formed on the U-shaped recess 211, the two arched strips 241 are disposed in parallel along both sides of the U-shaped recess 211, and the nesting groove 242 is formed between the two arched strips 241 to facilitate mutual nesting of the fast food spoons of the same specification. The upper surface of the two arched strips 241 is an inclined surface structure with an angle of inclination being 1.5°. The inclined surface high ends of the two arched strips 241 smoothly transition to an end of the U-shaped recess 211 through the first smooth transition portion 2411, and the inclined surface low ends of the two arched strips 241 smoothly transition to the lowest region of the spoon body 203 through the second smooth transition portion 2412.

One connection bridge 243 is disposed in the nesting groove 242 and located at a side of the first smooth transition portion 2411. An upper surface of the connection bridge 243 is lower than upper surfaces of the arched strips 241 where the connection bridge 243 is disposed. Information such as cavity position number may be printed on the connection bridge 243 to facilitate mass production. In addition, a height of the connection bridge 243 may be adjusted according to a nesting function requirement of the cutlery to control a nesting depth of the cutlery.

The handle 201, the transition portion 202, the spoon body 203 and the double arch reinforcing portion 204 are formed into an integral thin-walled fast food spoon with a thickness of 0.75 mm by using a degradable paper pulp material through one-time solidification.

Embodiment 2-2

Figure 16:
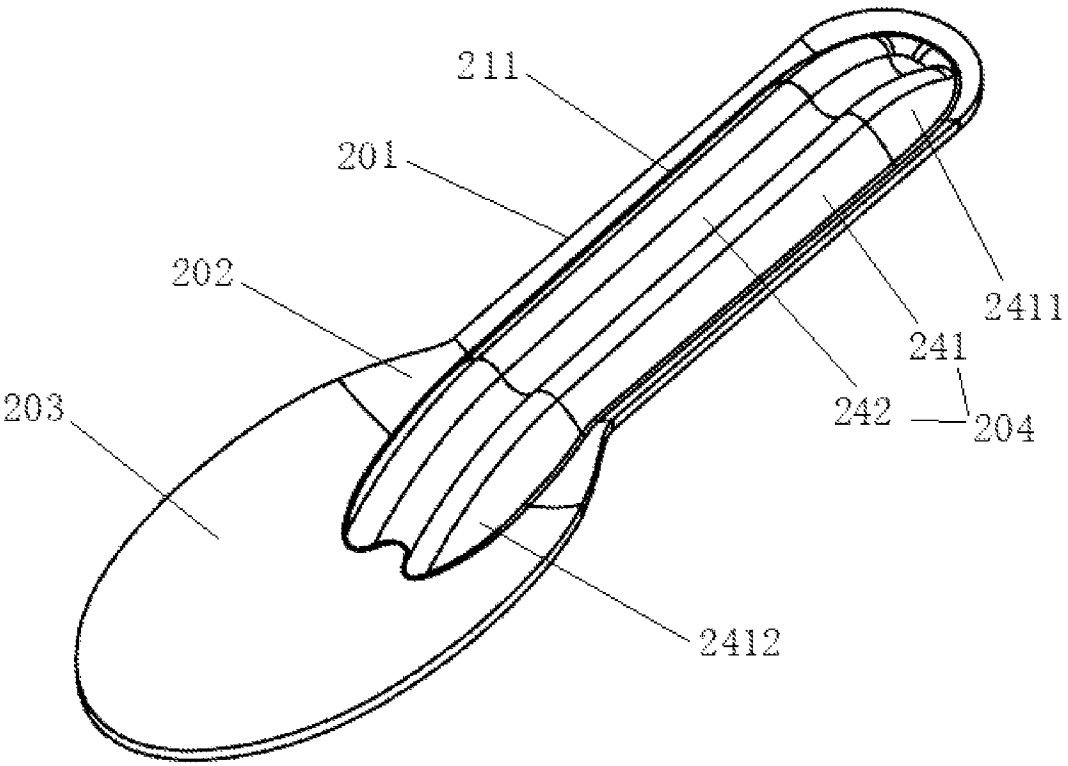
FIG. 16 is a stereoscopic diagram of an embodiment 2-2 of a disposable paper pulp fast food spoon according to the present disclosure.

As shown in FIG. 16, the handle 201, the transition portion 202 and the spoon body 203 form a fast food spoon body which has a total length of 89 mm The U-shaped recess 211 is formed downwardly along an edge on an upper surface of the handle 201, a distance from the U-shaped recess 211 to the edge of the handle 201 is about 0.5 mm, and the U-shaped recess 211 extends to the transition portion 202. The double arch reinforcing portion 204 formed by two arched strips 241 is formed on the U-shaped recess 211, the two arched strips 241 are disposed in parallel along both sides of the U-shaped recess 211, and the nesting groove 242 is formed between the two arched strips 241 to facilitate mutual nesting of the fast food spoons of the same specification. The upper surface of the two arched strips 241 is an inclined surface structure with an angle of inclination being 1.6°. The inclined surface high ends of the two arched strips 241 smoothly transition to an end of the U-shaped recess 211 through the first smooth transition portion 2411, and the inclined surface low ends of the two arched strips 241 smoothly transition to the lowest region of the spoon body 203 through the second smooth transition portion 2412.

The handle 201, the transition portion 202, the spoon body 203 and the double arch reinforcing portion 204 are formed into an integral thin-walled fast food spoon with a thickness of 0.6 mm by using a degradable paper pulp material through one-time solidification.

Embodiment 2-3

Figure 17:
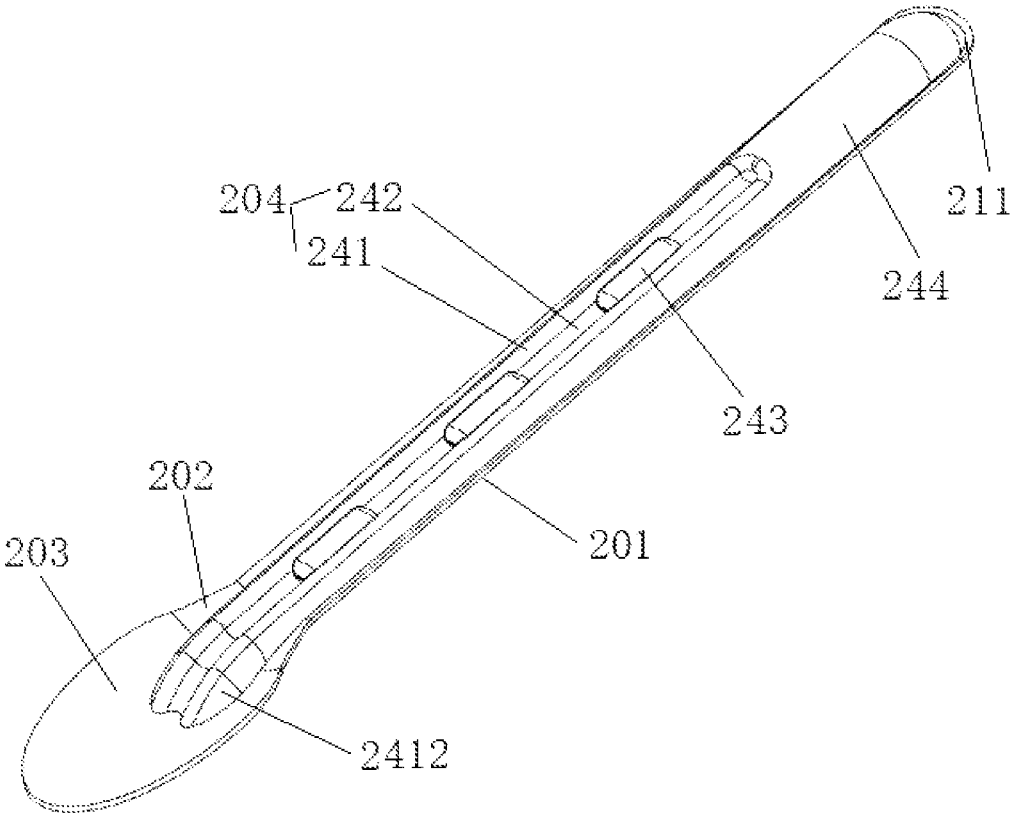
FIG. 17 is a stereoscopic diagram of an embodiment 2-3 of a disposable paper pulp fast food spoon according to the present disclosure.

As shown in FIG. 17, the handle 201, the transition portion 202 and the spoon body 203 form a fast food spoon body which has a total length of 210 mm The U-shaped recess 211 is formed downwardly along an edge on an upper surface of the handle 201, a distance from the U-shaped recess 211 to the edge of the handle 201 is about 0.5 mm, and the U-shaped recess 211 extends to the transition portion 202. The double arch reinforcing portion 204 formed by two arched strips 241 is formed on the U-shaped recess 211, the two arched strips 241 are disposed in parallel along both sides of the U-shaped recess 211, and the nesting groove 242 is formed between the two arched strips 241 to facilitate mutual nesting of the fast food spoons of the same specification. The upper surface of the two arched strips 241 is an inclined surface structure with an angle of inclination being 1.0°. The inclined surface high ends of the two arched strips 241 smoothly transition to an end of the U-shaped recess 211 through the third smooth transition portion 244, and the inclined surface low ends of the two arched strips 241 smoothly transition to the lowest region of the spoon body 203 through the second smooth transition portion 2412. The third smooth transition portion 244 is easy to grip, and the cavity position number may be printed on a front or back face of the third smooth transition portion 244 to facilitate mass production. Because the handle 201 of the fast food spoon body is long, three connection bridges 243 may be disposed in a spacing in the nesting groove 242 to prevent twist deformation of the handle 201.

The handle 201, the transition portion 202, the spoon body 203 and the double arch reinforcing portion 204 are formed into an integral thin-walled fast food spoon with a thickness of 0.6-0.9 mm by using a degradable paper pulp material through one-time solidification.

Knife

Figure 18:
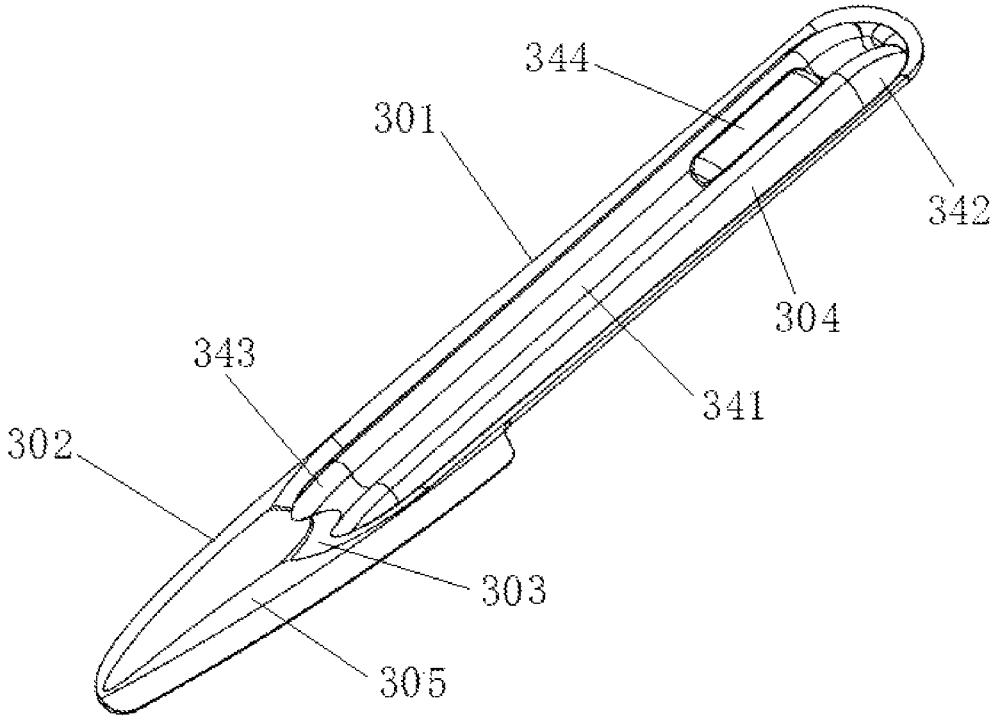
FIG. 18 is a perspective view of a disposable paper pulp fast food knife according to an embodiment 3-1 of the present disclosure.
Figure 19:
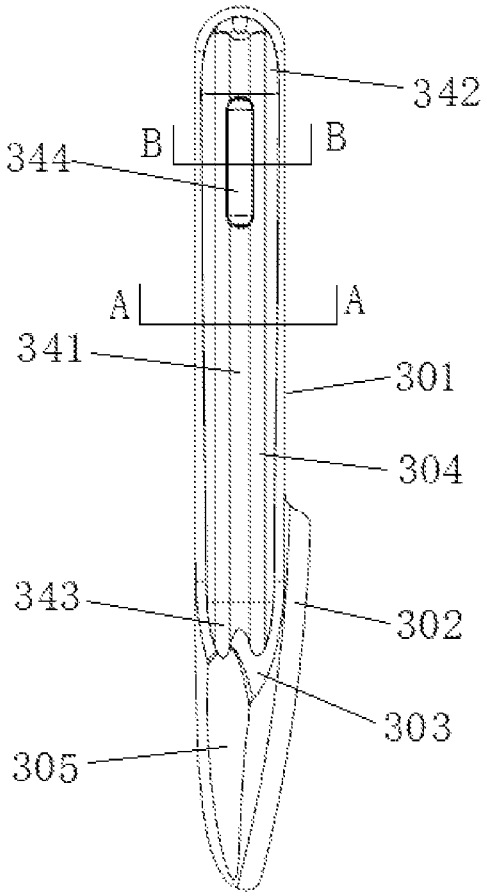
FIG. 19 is a front view of a disposable paper pulp fast food knife according to the embodiment 3-1 of the present disclosure.
Figure 23:
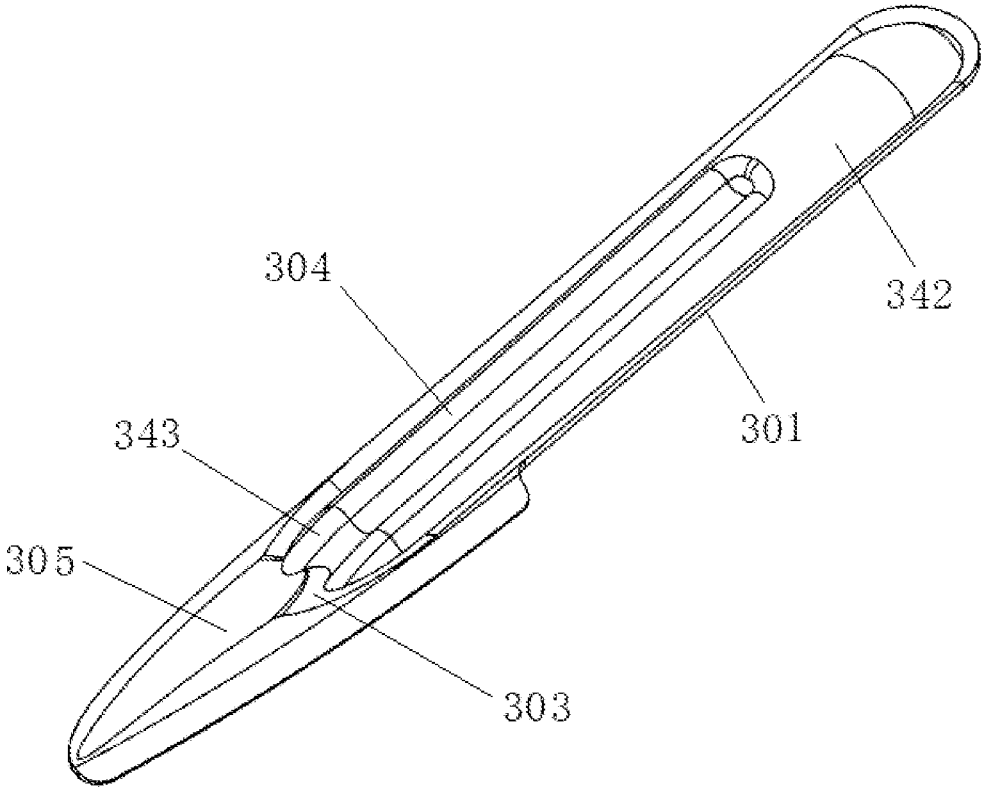
FIG. 23 is a perspective view of a disposable paper pulp fast food knife according to an embodiment 3-2 of the present disclosure.

As shown in FIGS. 18 and 23, provided is a disposable paper pulp fast food knife, including a handle 301 and a knife body 302. The knife body 302 is connected to an end of the handle 301, and the handle 301 and the knife body 302 both are located in a same plane to form a fast food knife body.

As shown in FIGS. 18-20, 23 and 24, a downwardly-recessed first groove body 303 is formed on an upper surface of the fast food knife body and extends from an end of the handle 301 to a middle portion of the knife body 302. Two knife body reinforcing ribs 304 are convexly disposed in the first groove body 303 and extend from an edge of an end of the handle 301 to the knife body 302. The two knife body reinforcing ribs 304 are disposed in parallel along a length direction of the handle 301, and a downwardly-recessed reinforcing groove 341 is formed between the two knife body reinforcing ribs 304 as shown in FIGS. 21 and 25. An undulated curved surface structure is formed by the handle 301, the first groove body 303 on the handle 301, the knife body reinforcing ribs 304 on the first groove body 303 and the reinforcing groove 341 between the two knife body reinforcing ribs 304, which greatly increases the strength of the handle 301, thus achieving better bending resistance and torsion resistance. A downwardly-recessed second groove body 305 is formed on an upper surface of the knife body 302. One end of the second groove body 305 is in smooth transitional connection with the first groove body 303, and the other end of the second groove body 305 extends to a tip of the knife body 302 along a length direction of the knife body 302. With the disposal of the second groove body 305 joining the first groove body 303, a load is better transferred so that the load of the knife body 302 can be directly transferred to the handle 301 to ensure effective use of the knife body 302. Even if a thin fast food knife body is made of paper pulp, the fast food knife body can still work normally.

An end of the knife body reinforcing rib 304 away from a cutting edge extends to a connection position of the first groove body 303 and the second groove body 305. In this way, a load of the knife body 302 can be transferred to the handle 301 along the second groove body 305, the first groove body and the knife body reinforcing ribs 304, thereby reducing occurrences of deformations of the knife body 302 and further guaranteeing effective use of the fast food knife body.

Figure 20:
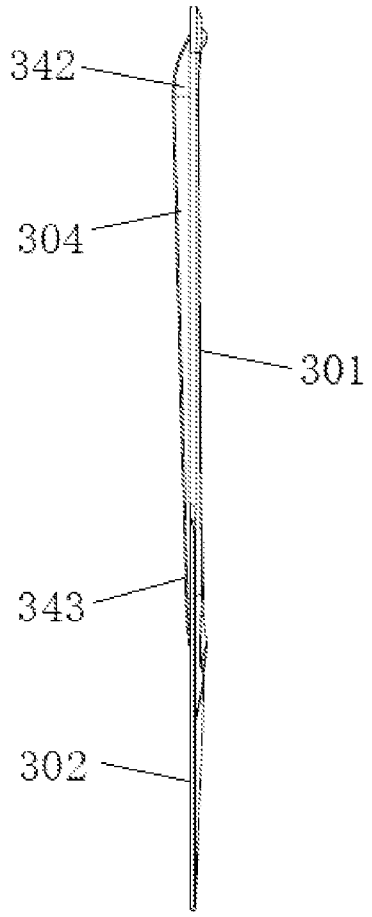
FIG. 20 is a side view of a disposable paper pulp fast food knife according to an embodiment 3-1 of the present disclosure.
Figure 21:
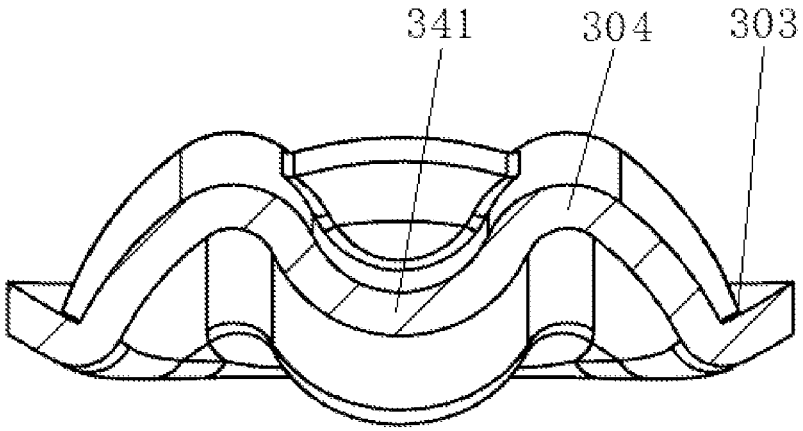
FIG. 21 is an enlarged sectional view taken along a line A-A in FIG. 19.
Figure 24:
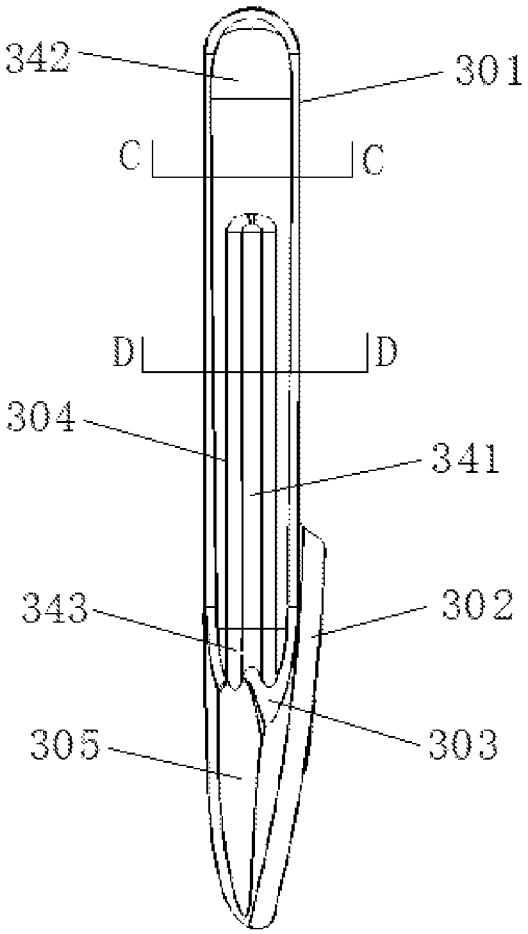
FIG. 24 is a front view of a disposable paper pulp fast food knife according to the embodiment 3-2 of the present disclosure.
Figure 25:
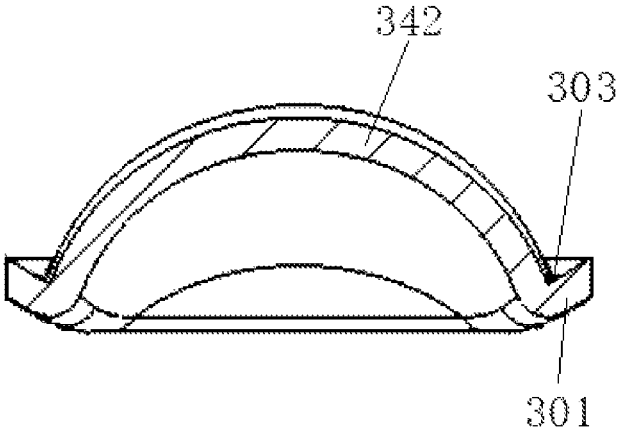
FIG. 25 is an enlarged sectional view taken along a line C-C in FIG. 24.

As shown in FIGS. 20 and 24, upper surfaces of the two knife body reinforcing ribs 304 are inclined surface structures higher than an upper surface of the handle 301. A high end of the inclined surface structure is located at an end of the handle 301, and a low end of the inclined surface structure is located on the knife body 302. The two knife body reinforcing ribs 304 of inclined surface structure increase the holding comfort of the handle 301 and facilitate transfer of a load from the knife body 302 to an end of the handle 301. Furthermore, its external appearance is made more beautiful.

The inclined surface structures of the two knife body reinforcing ribs 304 have an angle of inclination of 1.4°-1.6° and preferably 1.5°, which is helpful to mold opening and process operations.

A first transition portion 342 is formed at the high ends of the inclined surface structures of the two knife body reinforcing ribs 304, and a second transition portion 343 is formed at the low ends of the inclined surface structures of the two knife body reinforcing ribs 304. The knife body reinforcing ribs 304 are in smooth transitional connection with the first groove body 303 through the first transition portion 342, and the knife body reinforcing ribs 304 are in smooth transitional connection with the knife body 302 through the second transition portion 343. With disposal of the first transition portion 342 and the second transition portion 343, the connections of the two knife body reinforcing ribs 304 and the handle 301/the knife body 302 are made smoother and more beautiful, and transfer of the load is facilitated. In this way, the structural strength of both ends of the knife body reinforcing ribs is significantly increased.

The first transition portion 342 includes two strip-shaped first unit transition portions. Each of the knife body reinforcing ribs 304 is connected with the first unit transition portion to form an elongated reinforcing rib parallel to the length direction of the handle 301. Forming the integral elongated structure by joining the first unit transition portion to the knife body reinforcing rib 304 guarantees direct transfer of a load. Further, the structural strength and the aesthetics of the handle 301 are improved.

Figure 22:
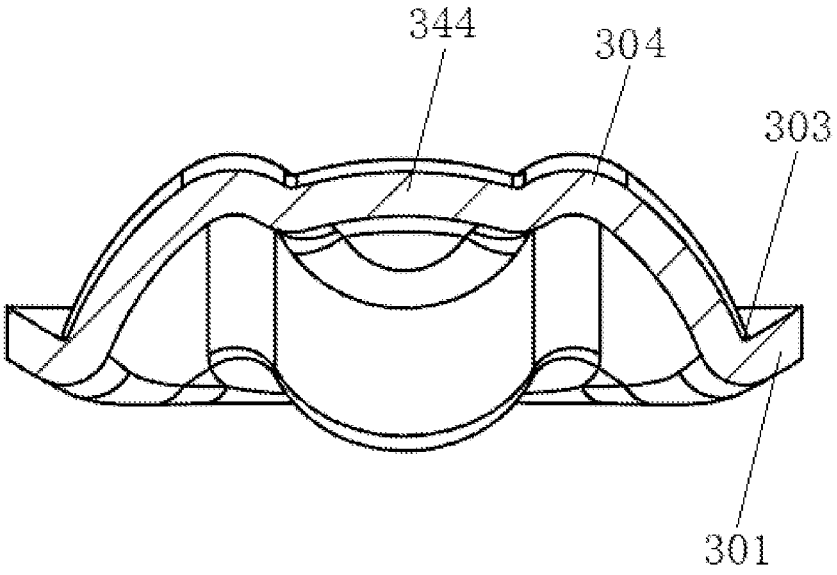
FIG. 22 is an enlarged sectional view taken along a line B-B in FIG. 19.

As shown in FIG. 22, a connection bridge 344 is disposed between the two elongated reinforcing ribs and located in the reinforcing groove 341. The disposal of the connection bridge 344 further increases the structural strength of the handle 301, especially the torsion resistance and improves the holding comfort. Further, information such as cavity position number may be printed on a surface of the connection bridge 344 to facilitate quality inspection and mold replacement and the like during batch production. Preferably, one connection bridge 344 is disposed. Alternatively, a plurality of connection bridges 344 may be disposed according to the length of the handle 301 and the design requirements. When a plurality of connection bridges 344 are disposed, these connection bridges 344 are spaced apart.

Figure 26:
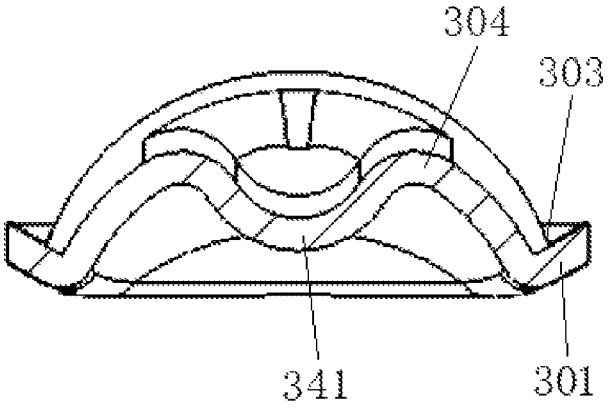
FIG. 26 is an enlarged sectional view taken along a line D-D in FIG. 24.

As shown in FIG. 26, the first transition portion 342 is an arc-surface structure such that the first transition portion 342 is in smooth transitional connection with the two knife body reinforcing ribs 304 and the first groove body 303. An arc-shaped holding structure is formed between the knife body reinforcing ribs 304 and the handle 301 by use of the first transition portion 342 of arc surface structure, so as to improve the holding comfort while ensuring the top strength of the handle 301.

The second transition portion 343 includes two strip-shaped second unit transition portions. Each of the knife body reinforcing ribs 304 is connected with the second unit transition portion to form an elongated reinforcing rib parallel to the length direction of the handle 301. One elongated reinforcing rib is in smooth transitional connection with the first groove body 303 and the other elongated reinforcing rib is in smooth transitional connection with the first groove body 303 and the second groove body 305. Forming the integral elongated structure by joining the second unit transition portion to the knife body reinforcing rib 304 guarantees direct transfer of a load. Further, the structural strength and the aesthetics of the handle 301 are improved.

The disposable paper pulp fast food knife is an integral thin-walled structure formed through paper pulp solidification, and has a thickness of 0.6-0.9 mm With the undulated reinforcing structure, the structural strength of the handle 301 is guaranteed such that the handle 301 can be still effectively used in a case of small thickness, thereby reducing production costs.

The disposable paper pulp fast food knife is used together with spoon and fork and has the same structure in handle as the spoon and fork. Therefore, the disposable paper pulp fast food knife can be nested with the spoon and fork sequentially through the handle 301 to form a cutlery combination. The cutlery combination is smaller in volume and therefore widely applied in the fast food delivery of trains, airplanes and the like.

Embodiment 3-1

As shown in FIGS. 18-22, the handle 301 and the knife body 302 form the fast food knife body. The first groove body 303 is formed on the fast food knife body and extends from an edge of an end of the handle 301 to a middle portion of the knife body 302. Two knife body reinforcing ribs 304 are disposed in parallel in the first groove body 303 along the length direction of the handle 301. The reinforcing groove 341 is formed between the two knife body reinforcing ribs 304. The reinforcing groove 341 may also be used as a nesting groove to facilitate nesting of the fast food knife bodies of the same specifications. The second groove body 305 is formed on the knife body 302 along the length direction of the knife body 302 and extends from a tip of the knife body 302 to the first groove body 303. The first groove body 303 and the second groove body 305 connect with one of the knife body reinforcing ribs 304 so as to enable a load on the knife body 302 to be effectively transferred to the handle 301.

The two knife body reinforcing ribs 304 have an angle of inclination of 1.5°. Ends of the two knife body reinforcing ribs 304 are in smooth connection with the first groove body 303 through the strip-shaped first transition portion 342, where the other end of one of the two knife body reinforcing ribs 304 is in smooth transitional connection with the first groove body 303 through the second transition portion 343, and the other end of the other of the two knife body reinforcing ribs 304 is in smooth transitional connection with a connection position of the first groove body 303 and the second groove body 305 through the second transition portion 343. One connection bridge 344 is disposed in the reinforcing groove 341 between the two knife body reinforcing ribs 304. The connection bridge 344 is disposed close to the first transition portion 342. With disposal of the two knife body reinforcing ribs 304, the first transition portion 342, the second transition portion 343, and the connection bridge 344, the fast food knife body has good bending resistance and torsion resistance.

In this embodiment, the disposable paper pulp fast food knife is integrally formed through paper pulp solidification, and has a thin-walled structure with a thickness of 0.6 mm Embodiment 3-2

As shown in FIGS. 23-26, the handle 301 and the knife body 302 form the fast food knife body. The first groove body 303 is formed on the fast food knife body and extends from an edge of an end of the handle 301 to a middle portion of the knife body 302. Two knife body reinforcing ribs 304 are disposed in parallel in the first groove body 303 along the length direction of the handle 301. The reinforcing groove 341 is formed between the two knife body reinforcing ribs 304. The reinforcing groove 341 may also be used as a nesting groove to facilitate nesting of the fast food knife bodies of the same specifications. The second groove body 305 is formed on the knife body 302 along the length direction of the knife body 302 and extends from a tip of the knife body 302 to the first groove body 303. The first groove body 303 and the second groove body 305 connect with one of the knife body reinforcing ribs 304 so as to enable a load on the knife body 302 to be effectively transferred to the handle 301.

The two knife body reinforcing ribs 304 have an angle of inclination of 1.4°. Ends of the two knife body reinforcing ribs 304 are in smooth connection with the first groove body 303 through the first transition portion 342 of arc-surface structure, where the other end of one of the two knife body reinforcing ribs 304 is in smooth transitional connection with the first groove body 303 through the second unit transition portion, and the other end of the other of the two knife body reinforcing ribs 304 is in smooth transitional connection with a connection position of the first groove body 303 and the second groove body 305 through another second unit transition portion. With disposal of the two knife body reinforcing ribs 304, the first transition portion 342 and the second transition portion 343, the fast food knife body has good bending resistance and torsion resistance.

In this embodiment, the disposable paper pulp fast food knife is integrally formed through paper pulp solidification, and has a thin-walled structure with a thickness of 0.6-0.9 mm.

The above descriptions are merely illustrative of preferred embodiments of the present disclosure rather than limiting of the scope of protection of the present disclosure. Therefore, any modifications, equivalent substitutions and improvements and the like made within the spirit and principle of the present disclosure shall all fall within the scope of protection of the present disclosure.

What is claimed is:

1. A pulp spoon comprising:

a handle;

a spoon body; and a transition portion by which the handle is connected with the spoon body, wherein the handle comprising two curved lateral edge portions, and a first double arch reinforcing structure disposed between the two curved lateral edge portions and extending along a length of the handle, an upper surface of the first double arch reinforcing structure being higher than the two curved lateral edge portions when the pulp spoon is in an upright position, wherein the transition portion comprising a second double arch reinforcing structure which extends from the first double arch reinforcing structure and toward the spoon body, wherein the spoon body comprising a third double arch reinforcing structure which extends from the second double arch reinforcing structure and toward a lowest region of the spoon body, and wherein the first double arch reinforcing structure, the second double arch reinforcing structure, and the third double arch reinforcing structure define a single one double arch reinforcing structure.

2. The pulp spoon of claim 1, wherein the first double arch reinforcing structure comprises two parallel arched strips and a nesting groove therebetween.

3. The pulp spoon of claim 2, wherein the nesting groove is higher than the two curved lateral edge portions.

4. The pulp spoon of claim 2, wherein the first double arch reinforcing structure further comprises at least one connection bridge in the nesting groove that connects the two parallel arched strips with each other.

5. The pulp spoon of claim 2, wherein the nesting groove is centrally disposed between the two curved lateral edge portions.

6. The pulp spoon of claim 5, wherein the nesting groove is disposed higher than the two curved lateral edge portions.

7. The pulp spoon of claim 1, wherein the handle, the spoon body and the transition portion form an integral structure.

8. A piece of pulp cutlery, comprising:

a handle;

a working body; and a transition portion by which the handle is connected with the working body, wherein the handle comprising two curved lateral edge portions, and a first double arch reinforcing structure disposed between the two curved lateral edge portions and extending along a length of the handle, an upper surface of the first double arch reinforcing structure being higher than the two curved lateral edge portions when the piece of pulp cutlery is in an upright position, wherein the transition portion comprising a second double arch reinforcing structure which extends from the first double arch reinforcing structure and toward the working body, and wherein the working body comprising a third double arch reinforcing structure which extends from the second double arch reinforcing structure and toward a lowest region of the working body, and wherein the first double arch reinforcing structure, the second double arch reinforcing structure, and the third double arch reinforcing structure define a single one double arch reinforcing structure.

9. The piece of pulp cutlery of claim 8, wherein the first double arch reinforcing structure comprises two parallel arched strips and a nesting groove therebetween.

10. The piece of pulp cutlery of claim 9, wherein the nesting groove is higher than the two curved lateral edge portions.

11. The piece of pulp cutlery of claim 9, wherein the first double arch reinforcing structure further comprises at least one connection bridge in the nesting groove that connects the two parallel arched strips with each other.

12. The piece of pulp cutlery of claim 8, wherein the handle, the working body and the transition portion form an integral structure.

13. The piece of pulp cutlery of claim 8, wherein the working body comprises one selected from the group consisting of a fork body, and a spoon body.

* * * * *